US012680482B2

(12) United States Patent
Patel et al.

(10) Patent No.: US 12,680,482 B2
(45) Date of Patent: Jul. 14, 2026

(54) VALVETRAIN COMPONENT COMPONENT COMPRISING AN OVERLOAD FEATURE

(71) Applicant: Jacobs Vehicle Systems, Inc., Bloomfield, CT (US)

(72) Inventors: Sanjaykumar Patel, Suffield, CT (US); Matei Alexandru, Simsbury, CT (US); Austen P. Metsack, Ashford, CT (US); Gabriel S. Roberts, Wallingford, CT (US); John Mandell, Vernon, CT (US); G. Michael Gron, Jr., Windsor, CT (US); Eric J. Hodgkinson, New Hartford, CT (US); Jarrett J. Stickels, Windsor, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 19/248,140

(22) Filed: Jun. 24, 2025

(65) Prior Publication Data

US 2026/0104000 A1 Apr. 16, 2026

Related U.S. Application Data

(60) Provisional application No. 63/664,006, filed on Jun. 25, 2024.

(51) Int. Cl.
*F01L 9/11* (2021.01)

(52) U.S. Cl.
CPC ..... *F01L 9/11* (2021.01)

(58) Field of Classification Search
CPC ..... F01L 13/00; F01L 9/11
See application file for complete search history.

(56) References Cited

U.S. PATENT DOCUMENTS

| | | | |
|---|---|---|---|
| 7,854,215 | B2 | 12/2010 | Rozario et al. |
| 9,797,279 | B2 | 10/2017 | Tomas et al. |
| 2021/0340891 | A1 | 11/2021 | Roberts et al. |
| 2022/0298935 | A1 | 9/2022 | Baltrucki |
| 2024/0125254 | A1 | 4/2024 | Gron, Jr. et al. |

FOREIGN PATENT DOCUMENTS

JP 2023549380 A * 11/2023 ..... F01L 1/181

OTHER PUBLICATIONS

International Search Report and Written Opinion of the International Search Authority for International Application No. PCT/IB2025/056421 dated Sep. 2, 2025, 8 pages.

* cited by examiner

*Primary Examiner* — Ngoc T Nguyen
(74) *Attorney, Agent, or Firm* — Jordan IP Law, LLC

(57) ABSTRACT

A valve train component for conveying valve actuation motions within an internal combustion engine is provided, which valve train component comprises a body member having a bore formed therein; a sliding member disposed in the bore; and an overload feature operatively connected to the body member and the sliding member. The overload feature is configured to not yield when a load placed on the overload feature is less than a load threshold, thereby preventing movement of the sliding member into the bore, and to yield when a load placed on the overload feature meets or exceeds the load threshold, thereby permitting movement of the sliding member into the bore such that at least a portion of the valve actuation motions is not conveyed by the valve train component.

19 Claims, 19 Drawing Sheets

VALVETRAIN COMPONENT COMPONENT COMPRISING AN OVERLOAD FEATURE

FIELD

The present disclosure concerns valvetrain components in internal combustion engines and, in particular, valvetrain components having an overload feature configured to yield during overload conditions.

BACKGROUND

Valvetrains are well known in the field of internal combustion engines. Particularly, valvetrains typically comprise one or more mechanical, electromechanical and/or hydraulic components configured to receive valve actuation motions from a valve actuation motion source (e.g., a cam) and convey such valve actuation motions to an engine valve. By appropriately timing application of so-called main valve actuation motions (for example, to one or more dedicated intake valves and one or more dedicated exhaust valves), the intake and output of gasses required for and produced by the combustion of fuel in an engine cylinder (i.e., positive power generation) may be achieved.

Alternative or auxiliary valve actuation motions, i.e., in place of or in addition to main valve actuation motions, are known in the art to achieve various beneficial modes of operation of an internal combustion engine. For example, compression-release engine braking, such as so-called 1.5 stroke or 2.0 stroke compression-release engine braking, is known in which the timing of valve actuation motions to either or both of the exhaust and intake valves of a cylinder are modified so as to operate a given cylinder essentially as an air compressor, such that kinetic energy of a vehicle is absorbed by the engine through the drive train of the vehicle. Indeed, systems have been developed that permit an internal combustion engine to switch between positive power generation (i.e., according to main valve actuation motions) and compression-release engine braking and/or other auxiliary operation.

A concern in internal combustion engines, including engines equipped to switch between positive power generation and, for example, engine braking operation, is the possibility that an intake valvetrain may try to open intake valves against excessively high cylinder pressure (also referred to as an overload condition). This may occur, for example, where a failure of an exhaust valve valvetrain has prevented any opening of, or only partial opening of, an exhaust valve. In such instances, higher than normal cylinder pressure will be maintained in the cylinder at the time that the intake valve valvetrain, which is typically not designed to handle high cylinder pressures, attempts to open an intake valve. This could lead to damage of one or more intake valvetrain components that, in turn, can lead to the need for costly and time consuming repairs.

Thus, valvetrain components that help mitigate or avoid such events from damaging intake valvetrain components would be a welcome addition to the art.

SUMMARY

The instant disclosure describes various embodiments of valve train components that address the above-described shortcomings. Thus, in an embodiment, a valve train component for conveying valve actuation motions within an internal combustion engine is provided, which valve train component comprises a body member having a bore formed therein; a sliding member disposed in the bore; and an overload feature operatively connected to the body member and the sliding member. The overload feature is configured to not yield when a load placed on the overload feature is less than a load threshold, thereby preventing movement of the sliding member into the bore, and to yield when a load placed on the overload feature meets or exceeds the load threshold, thereby permitting movement of the sliding member into the bore such that at least a portion of the valve actuation motions is not conveyed by the valve train component.

In an embodiment, the body member is an integral portion of the valve train component whereas, in another embodiment, the body member is a sleeve secured to the valve train component.

In an embodiment, sliding member comprises a sleeve configured to slide within the bore.

In an embodiment, movement of the sliding member into the bore is travel limited. Such travel limited movement of the sliding member into the bore may be configured to convey a high lift portion of the valve actuation motions.

In an embodiment, the overload feature yields irreversibly. In this case, the overload feature may, for example, comprise a shearing element disposed between the body member and the sliding member, a force fit between the sliding member and body member, at least one weld between the body member and the sliding member, or a frangible feature formed in the body member.

In an embodiment, the overload feature yields reversibly. In this case, the overload feature may, for example, comprise at least one resilient element, which resilient element may, for example, comprise a c-ring configured to engage notches formed in the body member and the sliding member, a constituent of at least one detent formed between the body member and the sliding member, or one or more Belleville washers residing in the bore between the body member and the sliding member.

In an embodiment, the overload feature comprises a one-way fluid supply in fluid communication with a portion of the bore between the body member and the sliding member; and a pressure relief valve in fluid communication with the portion of the bore between the body member and the sliding member.

In an embodiment, the valve train component is any of a tappet, a push tube, a rocker arm or a valve bridge.

In an embodiment, an internal combustion engine may any of the presently disclosed embodiments of a valve train component.

BRIEF DESCRIPTION OF THE DRAWINGS

The foregoing and other features and advantages will be discussed in detail in the following non-limiting description of specific embodiments in connection with the accompanying drawings, in which.

DETAILED DESCRIPTION OF THE PRESENT EMBODIMENTS

As used herein, phrases substantially similar to "at least one of A, B or C" or "any of A, B, or C" are intended to be interpreted in the disjunctive, i.e., to require A or B or C or any combination thereof unless stated or implied by context otherwise. Further, phrases substantially similar to "at least one of A, B and C" are intended to be interpreted in the conjunctive, i.e., to require at least one of A, at least one of B and at least one of C unless stated or implied by context otherwise. Additionally, the term "substantially" or similar words requiring subjective comparison are intended to mean "within manufacturing tolerances" unless stated or implied by context otherwise. Furthermore, as used herein, the phrase "operatively connected" refers to at least a functional relationship between two elements and may encompass configurations in which the two elements are directly connected to each other, i.e., without any intervening elements, or indirectly connected to each other, i.e., with intervening elements.

Figure 1:
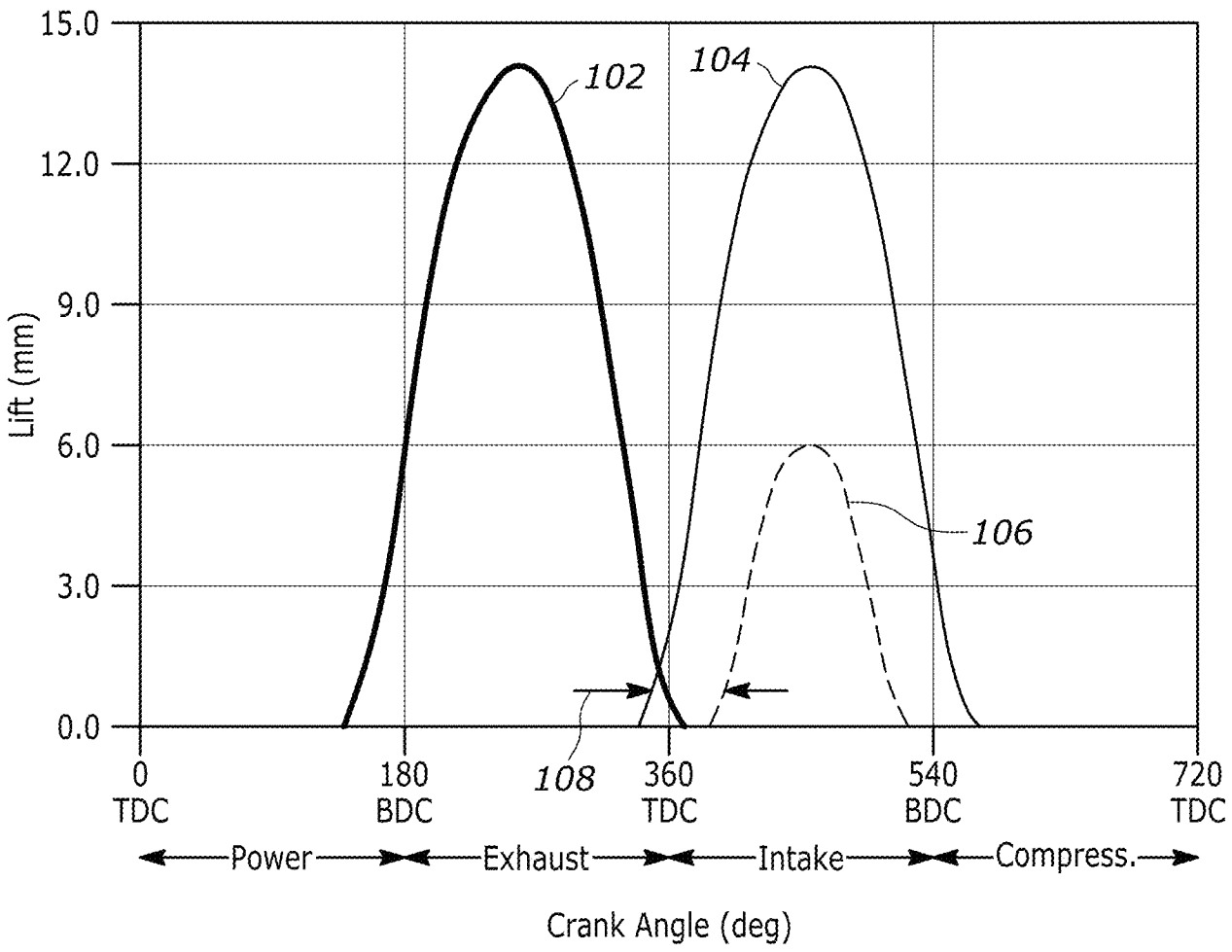
FIG. 1 is a graph illustrating examples of exhaust and intake valve actuation motions, including a reduced and delayed intake valve actuation motion, in accordance with the instant disclosure.

FIG. 1 illustrates a graph showing typical main valve actuation motions or lifts, including a main exhaust motion 102 and a main intake motion 104. As described above and for any given cylinder of an internal combustion engine, during positive power generation, the main exhaust motion 102 causes one or more exhaust valves to open during an exhaust stroke and during travel of a piston from bottom dead center (BDC) to top dead center (TDC), whereas the main intake motion 104 causes one or more intake valves to open during an intake stroke and travel of the piston from TDC to BDC. In the event that the main exhaust motion 102 does not occur or occurs only partially, an overload condition may be presented to the intake valvetrain during the main intake motion 104 due to the presence of combustion gasses retained in the cylinder when opening of the intake valve begins near TDC.

To address this possibility, the instant disclosure describes various valvetrain components and/or configurations that cause opening of intake valves to be delayed or, less preferably, entirely lost when an overload condition occurs. In an embodiment, such delay is achieved by effectuating a so-called "centered" lift 106 in which the amplitude or maximum lift experienced by the intake valves is reduced, as shown in FIG. 1. As known in the art, such a centered lift 106 also effectively causes a delay 108 in initiation of opening of the intake valve. Such delay provides time for cylinder pressure to decrease (i.e., for the overload condition to dissipate due to cylinder expansion as the piston travels from TDC to BDC) to a sufficient degree such that opening of the intake valve will not place excessive load on the intake valvetrain, thereby preventing or mitigating damage thereof.

Figure 2:
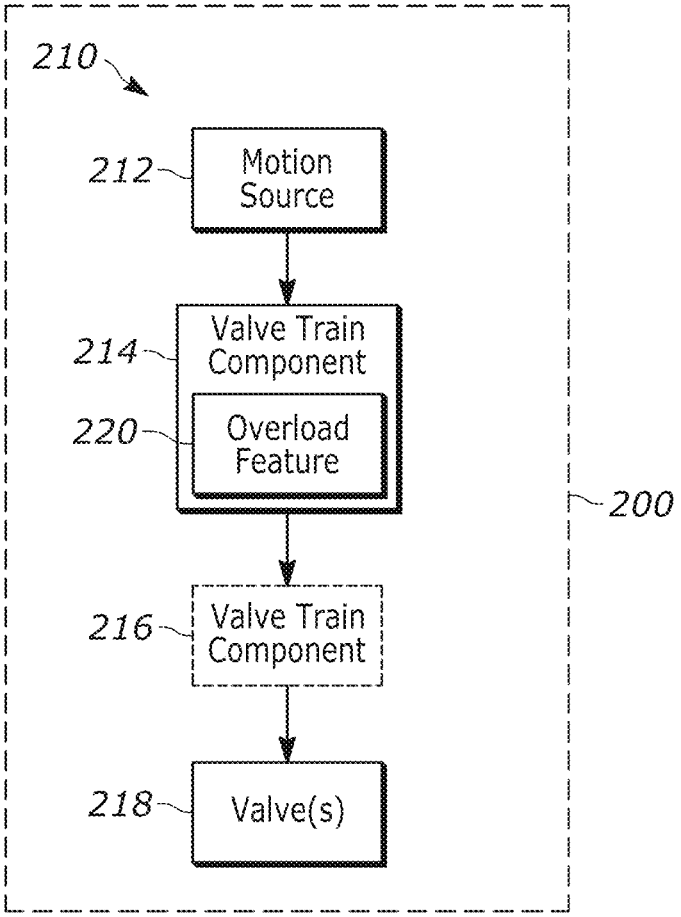
FIG. 2 is a schematic block diagram of an internal combustion engine comprising a valvetrain component having an overload feature in accordance with the instant disclosure.

Referring now to FIG. 2, a schematic illustration of an internal combustion engine 200 is presented. As is often the case, and though not explicitly depicted in FIG. 2, the internal combustion engine 200 may comprise multiple combustion cylinders. As known in the art, any given cylinder operates in conjunction with one or more valve trains 210 that start with a valve actuation motion source 212, end with one or more engine valve 219 and include one or more intervening valve train components 214, 216 as shown. It is noted that the second illustrated valve train component 216 is not required and is therefore shown with dashed lines. The valve actuation motion source 212 may comprise one or more cams providing valve actuation motions to the engine valve(s) 218 via the intervening valve train component(s) 214, 216. The valve train component(s) 214, 216 may comprise any of a number of such components as known in the art, including but not limited to, a tappet, a push tube, a rocker arm or a valve bridge.

In accordance with the instant disclosure, at least one valve train component 214 (also referred to herein as a host valve train component) in the valve train 210 is equipped with an overload feature 220, various examples of which are described in greater detail below. As used herein, an overload feature 220 may comprise one or more elements deployed within a host valve train component and configured to yield when a load placed on the overload feature exceeds a load threshold. Also as used herein, the term "yield" retains its common definition of giving way under physical force and is further understood to encompass both irreversible/non-resetting operation or reversible/resetting operation of the overload feature 220, as described in further detail below.

Various embodiments for achieving centered lifts of intake valves in light of an overload condition are described herein. As noted, such embodiments are generally divided into irreversible/non-resetting (FIGS. 3-14) and reversible/resetting (FIGS. 15-21) embodiments. The irreversible/non-resetting embodiments are generally characterized by the presence of a frangible overload feature deployed with the host valve train component and designed to yield in a destructive manner when a selected load threshold is surpassed. The reversible/resetting embodiments, on the other hand, are generally characterized by the presence of one or more constituent resilient and/or repositionable elements of the overload feature that, after yielding upon the load threshold being met or surpassed, can return to their "pre-failure" configurations upon unloading of the overload feature. In this manner, a given valve train comprising a host valve train component with an overload feature may be able to experience more than one overload condition without need of intervening repair or maintenance service.

It is noted that, while various embodiments of overload features discussed below are described as residing within or as a part of a specific host valvetrain component, e.g., a rocker arm, valve bridge, etc., it will be appreciated by those skilled in the art that such embodiments need not be limited to the specific host valvetrain components. For example, an overload component deployed within a rocker arm as an e-foot assembly may just as easily be disposed on a valve bridge and vice versa, or in some other valvetrain components altogether such as a pushrod, tappet, etc.

Figure 3:
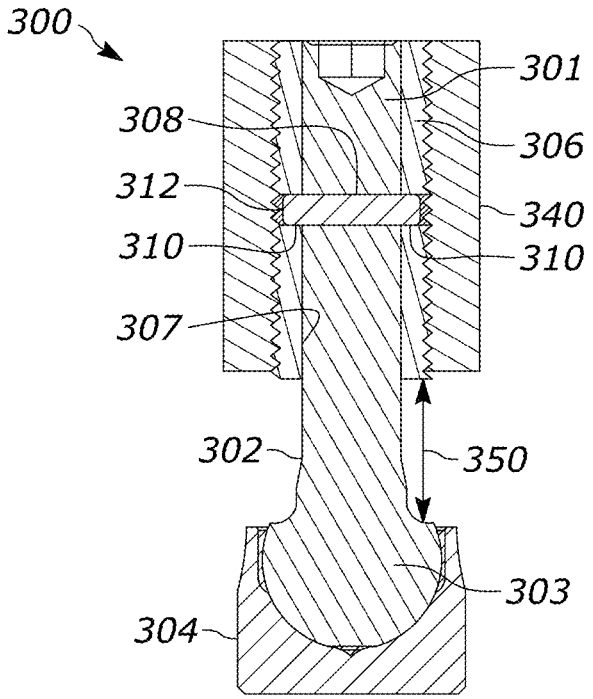
FIGS. 3-10 illustrate various embodiments of travel limited valve train components comprising non-resetting or irreversible overload features in accordance with the instant disclosure.

Referring now to FIG. 3, a cross-sectional view of a first non-resetting embodiment of an overload feature is illustrated in the form of a so-called "e-foot" assembly 300 of the type that may be found, for example, deployed within a host valvetrain component 340 such as a motion-conveying or valve-side end of a rocker arm. As known in the art, such e-foot assemblies 300 are often provided to contact a single valve (not shown) or a valve bridge (not shown) that, in turn, contacts two or more engine valve stems. In this embodiment, the assembly 300 comprises a rod or sliding member 302 having a spherical end 303 that, in turn, has a swivel or e-foot 304 disposed thereon. A shaft portion 301 of the rod 302 is slidably disposed within a sliding bore 307 of a sleeve 306, which constitutes a body member for the overload feature. As illustrated, an exterior surface of the sleeve 306 is provided with threads for threaded engagement with the host valve train component 340 such as a rocker arm.

As shown, both the rod 302 and sleeve 306 respectively comprise a diametrically extending pin bore 308, 310, wherein both pin bores 308, 310, when aligned with each other, are configured to receive a shear pin 312. As further shown, the shear pin 312 is configured to extend throughout the entirely of the rod's pin bore 308 and at least a portion of the sleeve's pin bore 310 such that the rod 302 and sleeve 306 are effectively locked together at two diametrically opposed points, but without the shear pin 312 extending beyond the exterior surface of the sleeve 306. In accordance with known techniques (i.e., suitable selection of fabrication material, shape, dimensions, etc.), the shear pin 312 is designed to destructively yield such that failure (i.e., complete shearing) will occur when presented with a load in excess of a selected threshold. For example, the shear pin 312 may be designed to fail if a load in excess of 10 kN is placed on the shear pin 312 (via the e-foot assembly 300). As will be appreciated by those skilled in the art, the specific failure threshold value will be largely dependent on a variety of factors pertaining to the design of the internal combustion engine in question, and specifically the valvetrain components used therein. More generally, the failure threshold for the shear pin 312 is preferably selected to avoid failure (by an appreciable margin) during normal, positive power generation and to be exceeded only during overload conditions that are highly unlikely to be encountered during positive power generation operation or even auxiliary operation such as compression-release braking, e.g., resulting from failure of an exhaust valve to open.

As further shown in FIG. 3, the rod 302 and sleeve 306 are designed such that, following failure of the shear pin 312, the rod 302 is permitted to travel into the sleeve bore 307 for a lost motion distance 350 until an upper surface of the spherical end 303 contacts a lower surface of the sleeve 306, thereby limiting further travel of the rod 302 into the bore 307.

Thus configured, the e-foot assembly 300 will provide the operation illustrated in FIG. 1. Specifically, during positive power generation, the main intake valve actuation motion 104 will be conveyed through the sleeve 306, shear pin 312, rod 302 and swivel 304 to a downstream valve train component (e.g., valve bridge) for normal opening and closing of the intake valves. However, if an overload condition develops, the continued application of the main intake valve actuation motion 104 and the inability of the intake valve to open will eventually cause the failure threshold to be exceeded, thereby resulting in failure of the shear pin 312. Such failure leads to the further result that the rod 302 will now be able to slide within the sleeve 306, more specifically, into the sliding bore 307, such that the overall length of the intake valvetrain path is shortened by an amount equal to the lost motion distance 350 (but less than the peak valve lift that would otherwise be provided by the main intake event 104), thereby permitting the centered valve lift 106 to occur. By limiting the amount of travel of the rod 302 into the sliding bore 307, the amount of lost valve train length can be controlled such that a desired amount of delay 108 is incurred by the center lift 106. Of course, it will be appreciated that the lost motion distance 350 could even be set such that the entirety of the main event 104 is lost.

A benefit of the configuration illustrated in FIG. 3 is that, upon failure of the shear pin 312, the fragments thereof will be contained within the respective pin bores 308, 310 and not permitted to migrate outside of the e-foot assembly 300. As a result, the chances of such fragments coming loose within the engine, and potentially causing further engine damage, are minimized if not wholly prevented. At most, any potential damage would be limited to the rod 302 and/or sleeve 306, both of which may be readily replaced.

Figure 4:
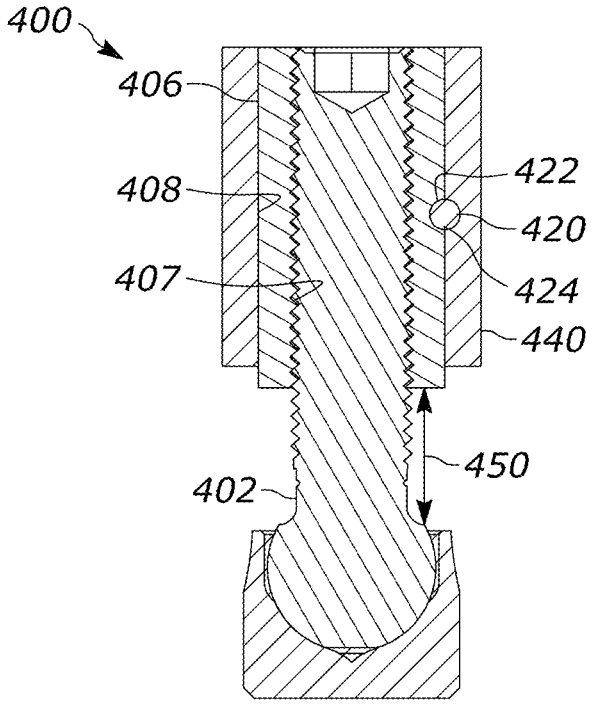

Referring now to FIG. 4, a cross-sectional view of a second non-resetting embodiment is illustrated in the form of another e-foot assembly 400. The e-foot assembly 400 is similar to the e-foot assembly 300 illustrated in FIG. 3 in that it comprises a rod 402 disposed within a sleeve 406. However, in this embodiment, the bore 407 of the sleeve 406 is configured for threaded engagement with the rod 402, whereas an exterior surface of the sleeve 406 is configured to be slidably disposed within a bore 408 formed in the host valvetrain component 440. Thus, the assembly of the rod 402 and the sleeve 406 constitutes a sliding member relative to the bore 408 formed in the body member, i.e., the host valve train component 440. In this case, positioning of the sleeve 406 within the bore 408 is maintained by a tangentially disposed shear pin 420 configured to engage a tangential notch 422 formed on the exterior surface of the sleeve 406 and a corresponding notch 424 formed on an interior surface of the host valvetrain component 440 in which the assembly 400 is disposed. Once again, the shear pin 420 is designed to fail when a selected failure threshold is exceeded, thereby permitting the sleeve 406 and rod 402 to slide (by a lost motion distance 450, as described above) relative to the host valve train component 440.

Figure 5:
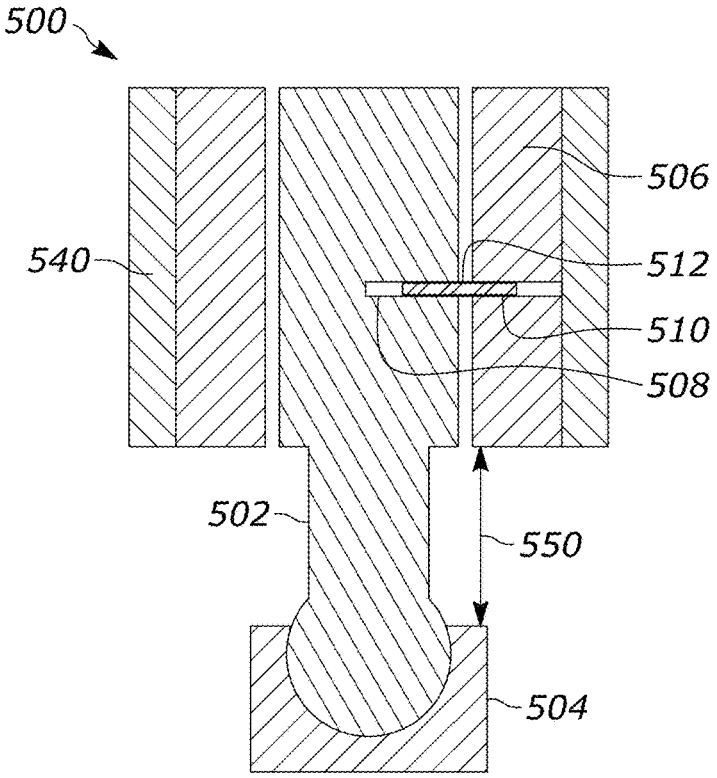

Referring now to FIG. 5, a cross-sectional view of a third non-resetting embodiment is illustrated in the form of another e-foot assembly 500. The e-foot assembly 500 is similar to the e-foot assembly 300 illustrated in FIG. 3 in that it comprises a rod 502 slidably disposed within a sleeve 506 that, in turn, is rigidly attached to a host valve train component 540 (e.g., via corresponding threads, not shown). However, in this embodiment, the rod 502 and sleeve 506 comprise radially extending bores 508, 510 configured to receive, when aligned with each other, a radially extending shear pin 512, as opposed to a diametrically extending shear pin 312 as shown in FIG. 3. Thus, unlike the embodiment of FIG. 3 in which the shear pin 312 secures the rod 302 to the sleeve/body member 306 at two points, the radially extending shear pin 512 provides only a single point at which the rod 502 is secured to the sleeve/body member 506. Once again, as shown, the rod 502 and e-foot 504 may be configured to contact the sleeve/body member 506 after travel of the rod 502 by a lost motion distance 550 into the sleeve/body member 506.

Figure 6:
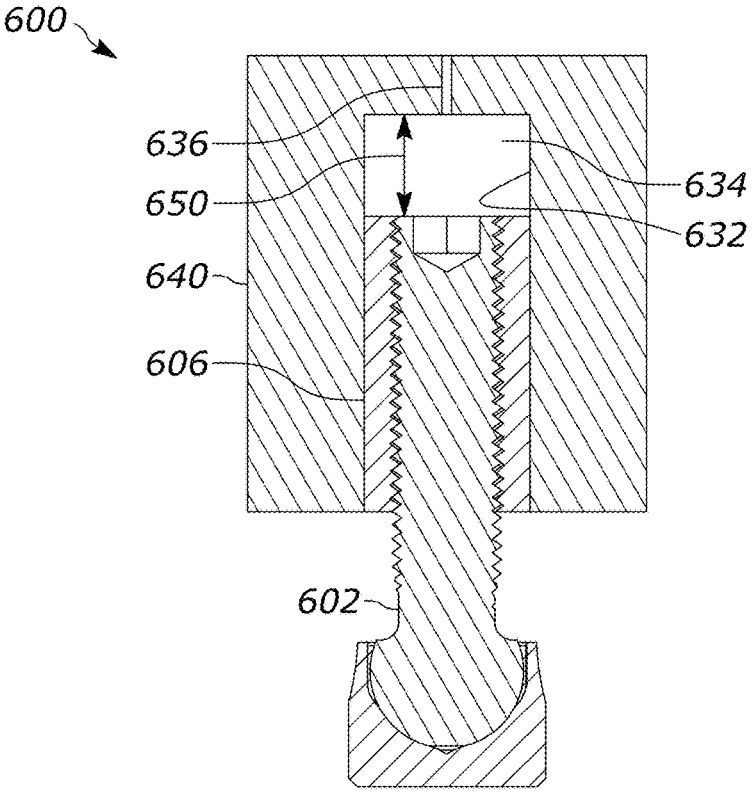

Referring now to FIG. 6, a cross-sectional view of a fourth non-resetting embodiment is illustrated in the form of another e-foot assembly 600. The e-foot assembly 600 is similar to the e-foot assembly 400 illustrated in FIG. 4 in that it comprises a rod 602 threadedly engaged within a sleeve 606 to collectively form a sliding member. However, in this embodiment, an outer diameter surface of the sleeve 606 is configured to provide a frictional or press fit with an interior surface of a bore 632 formed in a host valve train component 640. In accordance with known techniques, the frictional fit provided between the sleeve 606 and the bore 632 is designed to fail (i.e., to overcome the frictional engagement thereby permitting the sleeve 606 to slide further within the bore 632) when a sufficient load is placed on the assembly 600. In this embodiment, when the sleeve 606 is pressed into the bore 632, a space 634 may be provided such that, as the interface between the sleeve 606 and bore 632 yields, the sleeve 606 (and rod 602) is permitted to travel a lost motion distance 650 before solid contact is established between the rod 602/sleeve 606 and the closed end of the bore 632, thereby establishing the desired centered lift. As known in the art, a vent 636 may be provided at the closed end of the bore 632 to prevent formation of a pocket of incompressible fluid (i.e., air) that might otherwise hinder or prevent travel by the rod 602/sleeve 606 within the bore 632.

Figure 7:
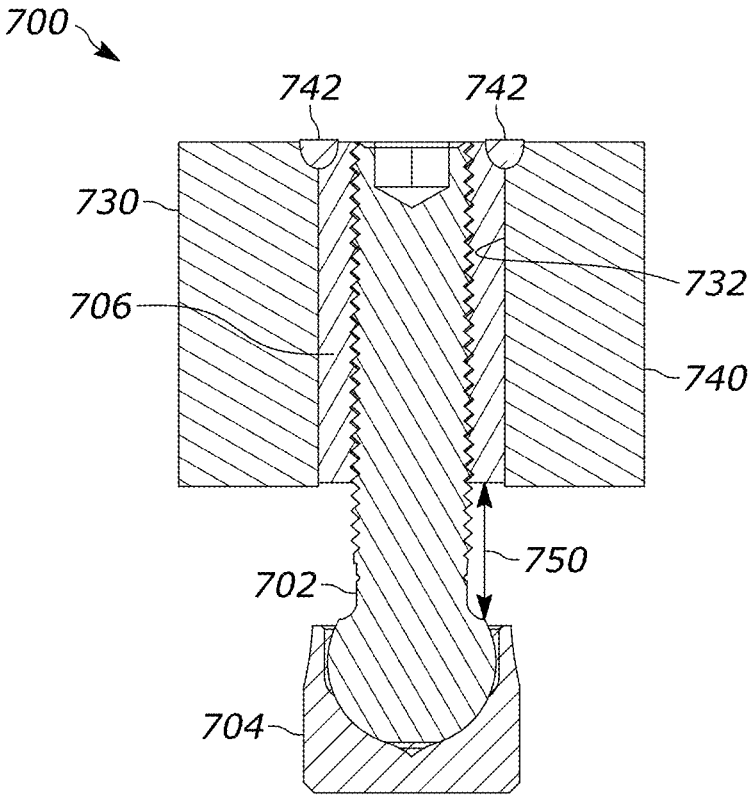

Referring now to FIG. 7, a cross-sectional view of a fifth non-resetting embodiment is illustrated in the form of another e-foot assembly 700. The e-foot assembly 700 is similar to the e-foot assembly 400 illustrated in FIG. 4 in that it comprises a rod 702 threadedly engaged within a sleeve 706 to collectively form a sliding member. However, in this embodiment, the sleeve 706 is slidably disposed with a bore 732 of a host valve train component 740. Furthermore, one or more welds or other lower temperature joints 742 are provided at an interface of the sleeve 706 and an interior surface of the bore 732, thereby rigidly coupling the sleeve 706 to the host valvetrain component 730 for all loads below a selected failure threshold. That is, using known techniques, the one or more welds/joints 742 may be fabricated (e.g., by virtue of the number of welds/joints, the depth or size of each weld/joint, etc.) to provide a desired failure threshold as described above. Once again, configuration of the rod 702/e-foot 704 relative to a lower surface of the host valve train component 740 permits travel of the rod 702/sleeve 706 into the bore 732 for a lost motion distance 750 after failure of the joints 742.

Figure 8A:
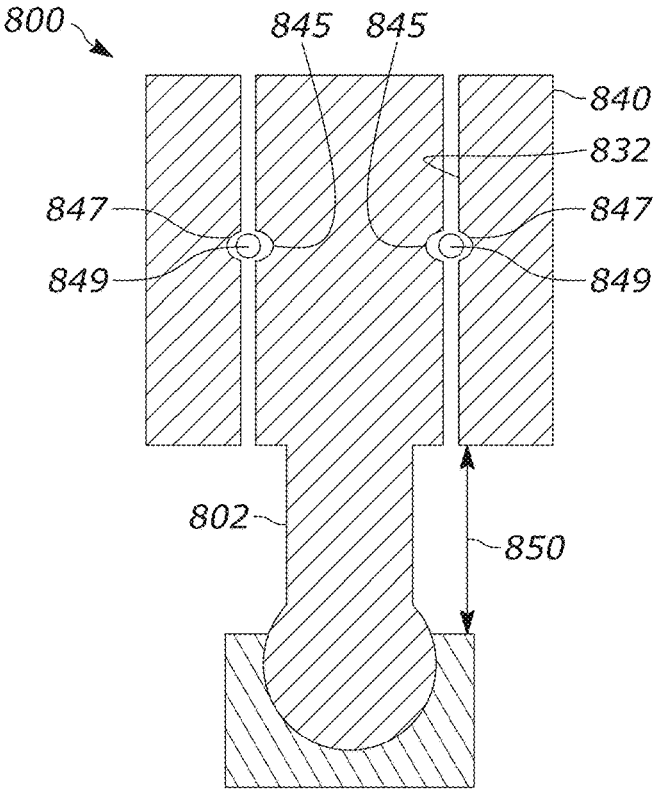
Figure 8B:
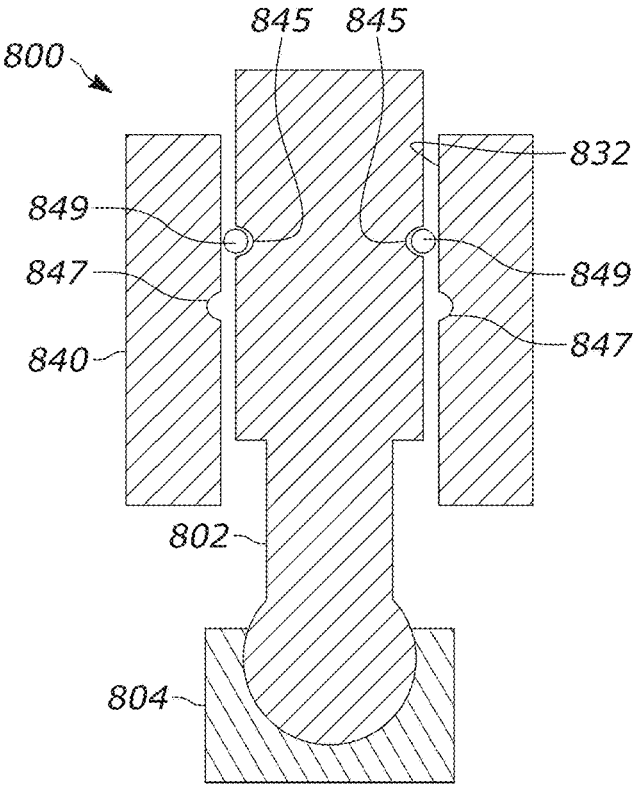

Referring now to FIGS. 8A and 8B, a cross-sectional view of a sixth non-resetting embodiment is illustrated in the form of another e-foot assembly 800. In this case, a rod 802 is slidably disposed in a bore 832 formed in a host valve train component 840. In this embodiment, the rod 802 comprises an annular notch 845 formed in an outer surface of the rod 802, whereas the host valvetrain component 830 comprises a similarly dimensioned (e.g., radial depth, height, etc.) annular notch 847 formed on an interior surface of the bore 832. Furthermore, a c-ring 849 is provided and configured to simultaneously engage with both of the annular notches 845, 847. When the annular notches 845, 847 are aligned (vertically, as depicted in FIG. 8A), the c-ring 849 is permitted to expand such that it is capable of simultaneously contacting both the annular notches 845, 847 at the same time. In this manner, as depicted in FIG. 8A, the c-ring 849 effectively couples the rod 802 to the host valvetrain component 840.

However, when, as depicted in FIG. 8B, a sufficient load is placed on the assembly 800, interaction of the c-ring 849 with the annular notch 847 provided in the host valve train component 840 will cause the c-ring 849 to flex inwardly and more fully into the annular notch 845 provided in the rod 802. As the c-ring 849 retracts from the annular notch 847 in the host valvetrain component 830, the ability of the c-ring 849 to maintain alignment of the annular notches 845, 847 will eventually be exceeded, thereby permitting the rod 802 to slide within the bore 832. It is also understood that the c-ring 849 could instead flex outwardly due to interaction with the inner annular notch 845 when place in an overload condition, to the same effect in terms of permitting the rod 802 to slide within the bore 832. Regardless, once again, configuration of the rod 802/e-foot 804 relative to a lower surface of the host valve train component 840 permits travel of the rod 802/sleeve 806 into the bore 832 for a lost motion distance 850 after the c-ring 849 yields as described above.

Figure 9:
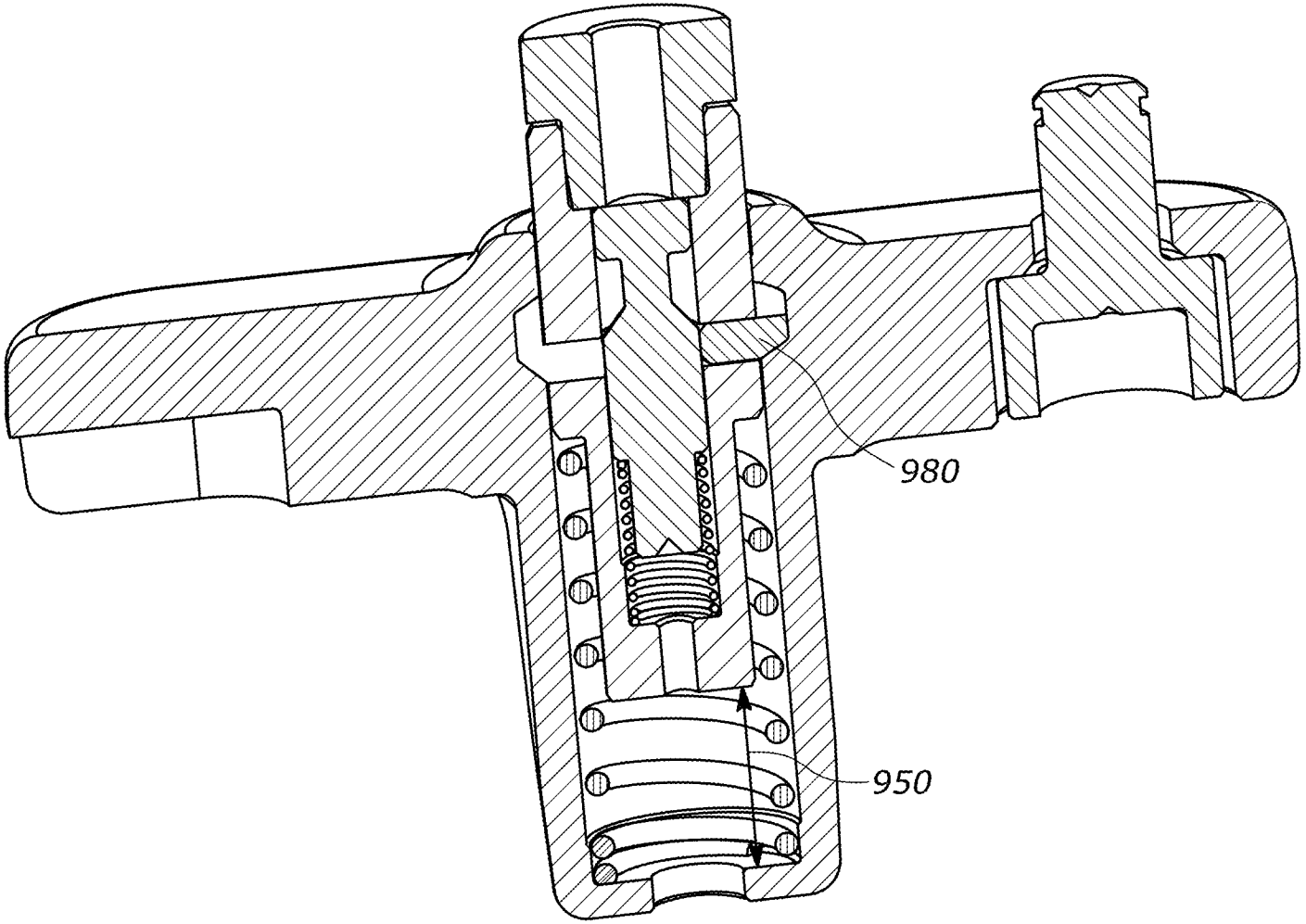

Referring now to FIG. 9, a perspective, cross-sectional view of a seventh non-resetting embodiment is illustrated in the form of a valve bridge as depicted in FIG. 5 of U.S. Pat. No. 11,619,180 ("the '180 patent"). As described in the '180 patent, the valve bridge comprises a locking mechanism comprising two locking wedges 580 deployed within a plunger 560 and configured to engage with an outer recess 580 formed in the valve bridge body 510. The locking wedges 580 are configured to bear loads placed on the plunger 560 by a valve actuation motion source (not shown), thereby conveying them to the valve bridge body 510 and on to engine valves (not shown).

In the presently disclosed embodiment, however, only a single wedge 980 is provided in the locking mechanism. In essence, the provision of only a single wedge 980 weakens the ability of the locking mechanism to bear loads applied to the plunger. Through appropriate design of the single wedge 980, the locking mechanism may be configured to exhibit a failure threshold (through shearing failure of the single wedge 980) only when presented with an overload condition, thereby permitting the plunger to travel a lost motion distance 950 with a bore formed in the valve bridge body. In this case, however, the lost motion distance 950 is defined between a lower surface of the plunger and a lower surface of the bore in which the plunger travels. Alternatively, both wedges illustrated in the '180 patent could be retained in the present embodiment, but reduced in thickness to achieve the same result, i.e., failure of the wedges when placed in an overload condition.

Figure 10:
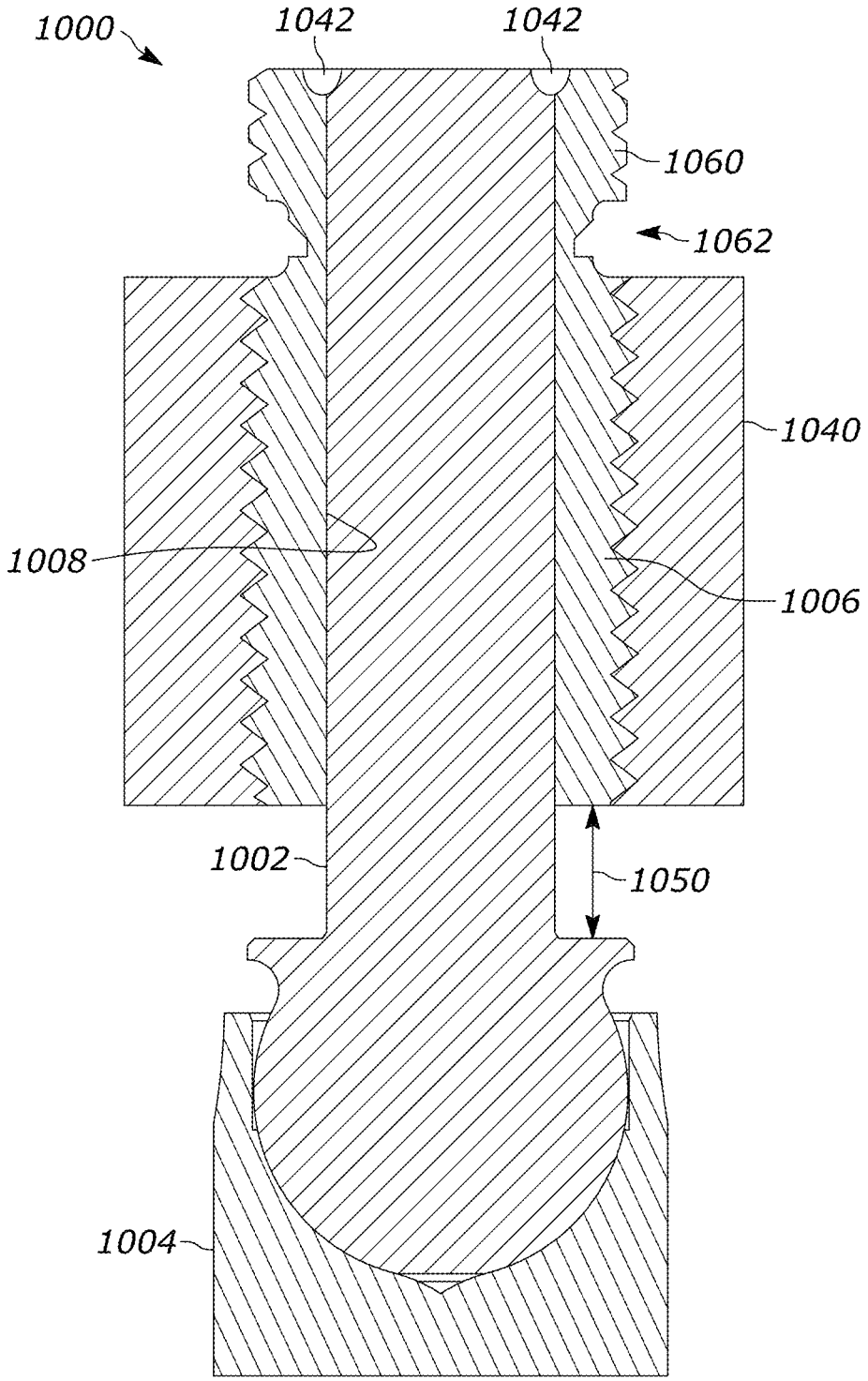

Referring now to FIG. 10, a side, cross-sectional view of an eighth non-resetting embodiment is illustrated in the form of another e-foot assembly 1000. In this embodiment, a rod 1002/e-foot 1004 assembly is slidably disposed in a bore 1008 of a sleeve 1006 that, in turn is threadedly secured within a bore formed in the host valve train component 1040. In this case, the sleeve 1006 also includes a reduced thickness region 1062 that delimits an upper portion 1060 of the sleeve 1006. As further shown, one or more welds or other lower temperature joints 1042 are provided at an interface of the upper portion 1060 of the sleeve 1006 and an interior surface of the bore 1008, thereby rigidly coupling the rod 1002 to the sleeve 1006. However, in this embodiment, such joints 1042 are configured to resist failure for all loads that may be placed on the e-foot assembly 1000. Though welds/joints 1042 are illustrated in FIG. 10, it is appreciated that other elements (e.g., pins similar to those illustrated in FIGS. 3-5, or other similar elements) may be used to secure the rod 1002 to the sleeve 1006 in non-yielding fashion.

In this case, the reduced thickness region 1062 is configured to yield when subjected to loads greater than or equal to an overload threshold. That is, in accordance with known techniques, a tensile strength of the reduced thickness region 1062 is designed such that it will fail destructively when subjected to loads greater than or equal to the desired overload threshold. Upon such failure, the upper portion 1060 of sleeve will be free to travel along with the rod 1002, which will then slide within the bore 1008. As with previous embodiments, configuration of the rod 1002/e-foot 1004 relative to a lower surface of the host valve train component 1040 permits travel of the rod 1002 into the bore 1008 for a lost motion distance 1050 after failure of the reduced thickness region 1060.

Figure 11A:
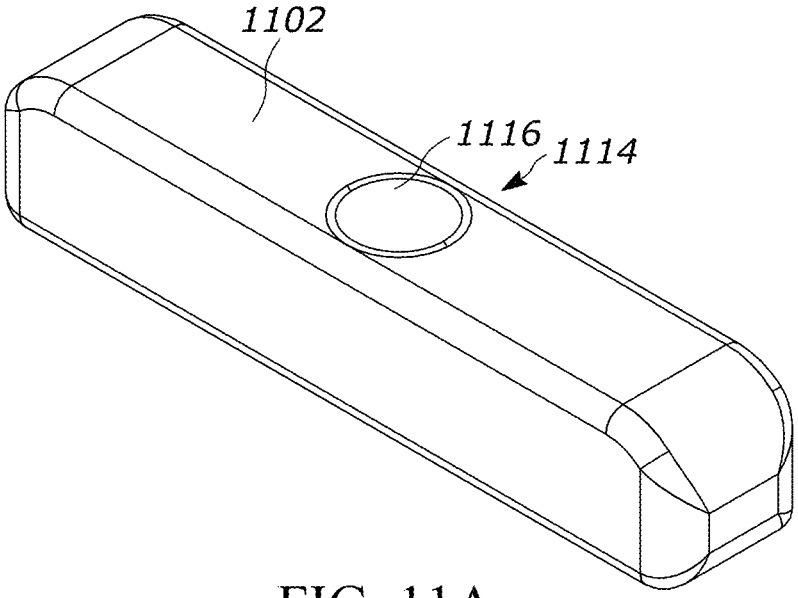
FIGS. 11-14 illustrate various embodiments of valve train components comprising frangible, non-resetting or irreversible overload features in accordance with the instant disclosure.
Figure 11B:
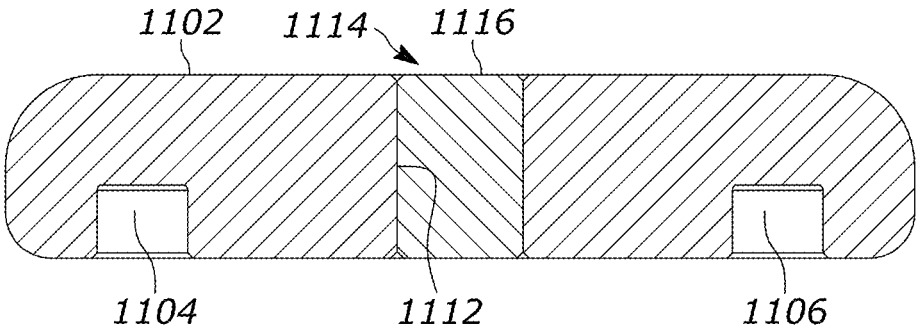

Referring now to FIGS. 11A and 11B, respective perspective and cross-sectional views of a ninth non-resetting embodiment are illustrated in the form of a valve bridge 1102. As shown, and in accordance with well-known techniques, the valve bridge 1102 is configured to span between two or more engine valve stems (not shown) and comprises pockets 1104, 1106 formed on an underside thereof and configured to receive the respective valve stems. The valve bridge 1102 further comprises, at a central location 1114 thereof, a through bore 1112 extending through the entire thickness of the body of the valve bridge 1102. Further, a plug 1116 is disposed in the bore 1112. Preferably, the plug 1116 is disposed in the bore 1112 such that an upper surface of the plug 1116 is substantially flush with an upper surface of the valve bridge 1102, as shown in the FIGS. An outer diameter surface of the plug 1116 is configured to provide a frictional or press fit with an interior surface of the bore 1112. In accordance with known techniques, the frictional fit provided between the plug 1116 and the bore 1112 is designed to yield (i.e., to overcome the frictional engagement thereby permitting the plug 1116 to slide further within the bore 1112) when a sufficient load is placed on the valve bridge 1102 at the central location 1114, specifically on the plug 1116.

For example, where a conventional e-foot assembly is used to convey valve actuation motions from, for example, a rocker arm to the valve bridge 1102, the e-foot assembly will be aligned with the central location 1114 and configured to contact the upper surface of the plug 1116. During normal, positive power generation operation, the frictional fit of the plug 1116 will be sufficient to ensure that any valve actuation motions applied thereto will be conveyed to the valve bridge 1102 and, subsequently, the engine valves. However, when faced with an overload condition, the continued application of a valve actuation motion to the plug 1116 will eventually overcome the frictional fit of the plug 1116 within the bore 1112. Although not shown in FIGS. 11A and 11B, in an embodiment, the plug 1116 is preferably configured to be travel limited within the bore 1112 such that the plug 1116 is not permitted to be completely removed from the bore 1112. However, this is not a requirement.

Figure 12A:
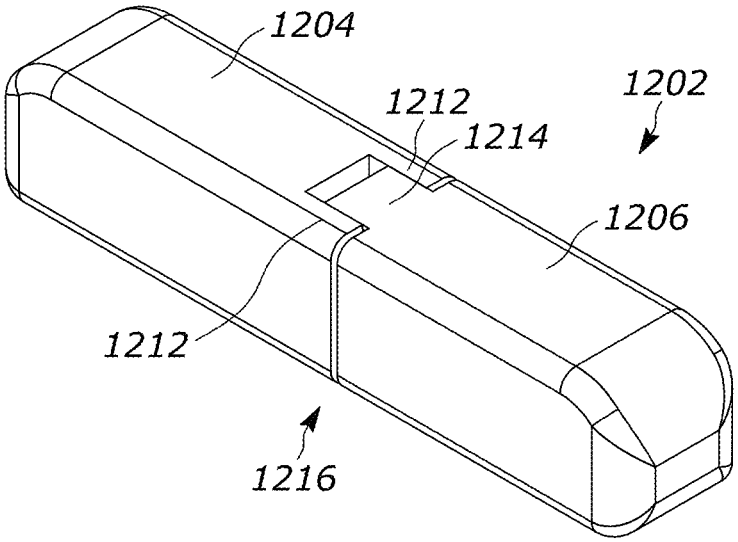
Figure 12B:
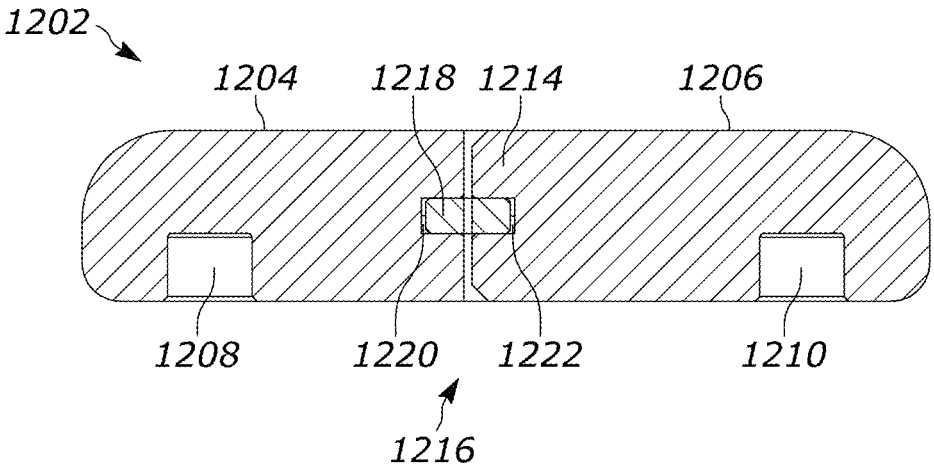

Referring now to FIG. 12, a bottom-up view of a tenth non-resetting embodiment is illustrated in the form of another valve bridge 1202. In this embodiment, the valve bridge 1202 comprises a first bridge portion 1204 and a second bridge portion 1206, where each bridge portion 1204, 1206 comprises a respective pocket 1208, 1210 configured to receive an engine valve stem (not shown). The bridge portions 1204, 1206 also respectively comprise projections 1212, 1214 configured to interdigitate at a central location 1216 between the valve stems such that the bridge portions 1204, 1206 collectively span the distance between the valve stems. As with the embodiment of FIG. 11, the central location 1216 corresponds to the point where an upstream valve train component, such as a rocker arm with an e-foot assembly, contacts the valve bridge 1202, though this is not a requirement.

The bridge portions 1204, 1206 respectively also comprise bores 1220, 1222 configured to receive a shear pin 1218 when the bores 1220, 1222 are aligned with each other. In the illustrated embodiment, the bore 1220 formed in the first bridge portion 1204 is formed within the gap established between the two projections 1212 formed thereon, whereas the bore 1222 is formed in the projection 1214 of the second bridge portion 1206. The shear pin 1218 thus locks the projections 1212, 1214 in their interdigitated state such that the bridge portions 1204, 1206 operate as a single unit when placed upon the valve stems. Once again, the shear pin 1218 is designed to fail only during overload conditions, i.e., such that normal, positive power generation valve actuations are conveyed by the valve bridge 1202, whereas an overload condition will cause the shear pin 1218 to destructively yield, thereby permitting the first and second bridge portions 1204, 1206 to separate and prevent damage to the other valvetrain components.

Figure 13:
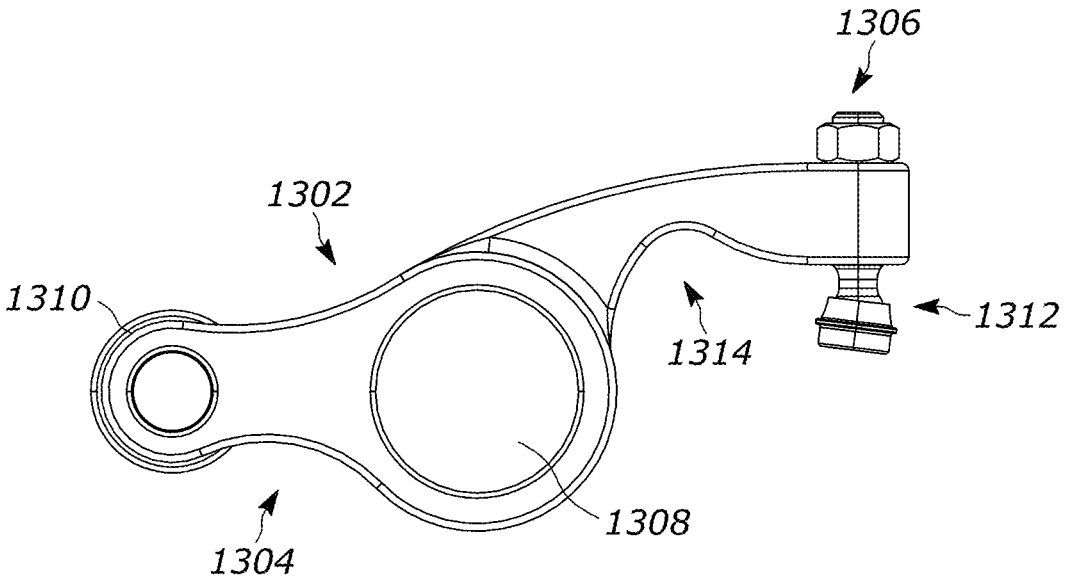

Referring now to FIG. 13, a side, cross-sectional view of an eleventh non-resetting embodiment is illustrated in the form of a rocker arm 1302. In this embodiment, the rocker arm 1302 is a center-pivot or Type III rocker arm having a motion receiving end 1304, a motion imparting end 1306 and a central opening 1308 configured to receive a rocker shaft (not shown), as known in the art. As illustrated, the motion receiving end 1304 of the rocker arm 1302 comprises a roller follower 1310 configured to receive valve actuation motions from a valve actuation motion source such as a cam (not shown). Additionally, the motion imparting end 1306 of the rocker arm 1302 comprises a conventional e-foot assembly 1312 configured to contact a downstream valvetrain component such as a valve bridge (not shown).

The rocker arm 1302 further comprises a reduced thickness or frangible feature 1314 in the form of a notch formed in the motion imparting end 1306 of the rocker arm 1302. The notch 1314 is designed to weaken the rocker arm 1302 such that the rocker arm 1302 is capable of conveying valve actuation motions for normal, positive power generation operation, but yield (fracture) only during an overload condition. Though the frangible feature 1314 is depicted on the motion imparting end 1306 of the rocker arm 1302, it is appreciated that the frangible feature 1314 could be equally deployed on the motion receiving end 1304 of the rocker arm 1302. Furthermore, though the frangible feature 1314 is illustrated in FIG. 13 as an essentially partially circular notch, it is appreciated that the notch 1314 may be formed with different cross-sectional profiles, e.g., a v-notch, a rectangular notch, etc. Further, other features may be employed to provide the desired weakening of the rocker arm 1302, e.g., one or more holes, a chemically treated region, a heat treated region, etc. Further still, though the rocker arm 1302 is depicted as a Type III rocker, those skilled in the art will appreciate that a weakening feature substantially similar to the frangible feature 1314 shown in FIG. 13 may be equally applied to other types of rocker arms, e.g., Type II rocker arms.

Figure 14:
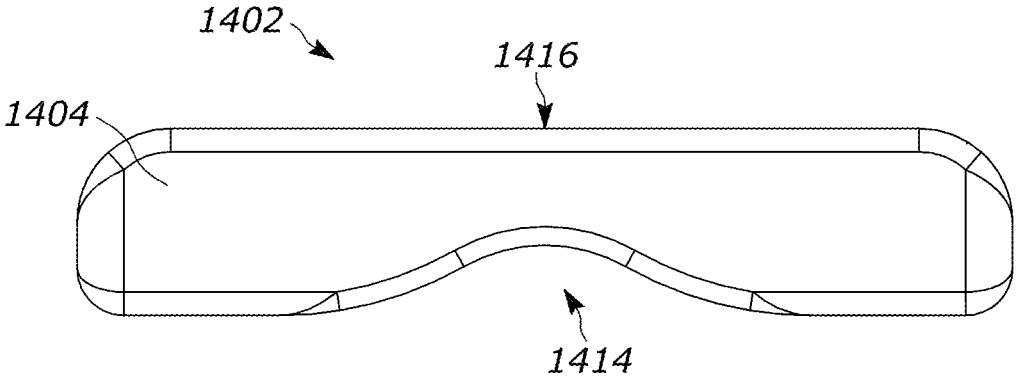

Referring now to FIG. 14, a side view of a twelfth non-resetting embodiment is illustrated in the form of a valve bridge 1402. In this embodiment, the valve bridge 1402 is formed as a unitary body 1404 having, once again, pockets (not shown) configured to respectively receive engine valve stems (not shown). In this embodiment, however, the body 1404 of the valve bridge 1402 comprises a reduced thickness or frangible feature 1414 in the form of a notch disposed on an underside surface of the body 1404 at a central location 1416. As with the embodiment of FIG. 10, the notch 1414 is designed to weaken the valve bridge body 1404 such that the valve bridge 1402 is capable of conveying valve actuation motions for normal, positive power generation operation, but yield (fracture) only during an overload condition. Though the frangible feature 1414 is depicted at the central location 1416 of the bridge body 1404, it is appreciated that the frangible feature 1414 could be equally deployed elsewhere along the span of the bridge body 1404 between the pockets for receiving the valve stems. Further, though the frangible feature 1414 is illustrated in FIG. 10 as a partially circular notch, it is appreciated that the notch 1414 may be formed with different cross-sectional profiles, e.g., a v-notch, a rectangular notch, etc. Furthermore, it is again appreciated that other features may be employed to provide the desired weakening of the bridge body 1404, e.g., one or more holes, a chemically treated region, a heat treated region, etc.

Figure 15:
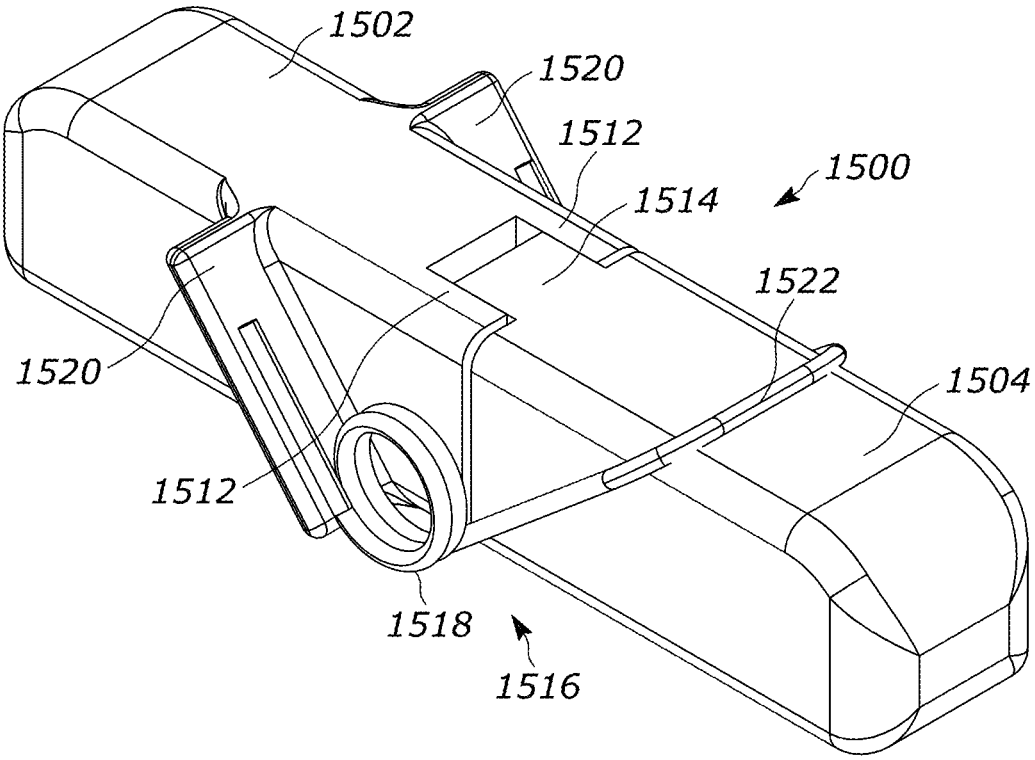
FIGS. 15-20 illustrate various embodiments of travel limited valve train components comprising resetting or reversible overload features in accordance with the instant disclosure.

Referring now to FIG. 15, a cross-sectional view of a first resetting embodiment is illustrated in the form of a valve bridge 1500. In this embodiment, and similar to the embodiment of FIG. 12, the valve bridge 1500 comprises two bridge portions 1502, 1504 respectively mounted on spherical mounts (not shown) each comprising a respective pocket configured to receive a respective engine valve stem (not shown). Each of the bridge portions 1502, 1504 is configured rotate about (while still being retained on) its corresponding spherical mount such that each bridge portion 1502, 1504 forms a cantilever-type structure relative to its corresponding valve. The bridge portions 1502, 1504 also respectively comprise projections 1512, 1514 configured to interdigitate at a central location 1516 between the valve stems such that the bridge portions 1502, 1504 collectively span the distance between the valve stems such that the distal ends of the bridge portions 1502, 1504 (relative to the valve stem mounts) are in close proximity to each other at a central location 1517 without contacting each other. Although, disclosed with spherical mounts, other known practices could be used to permit rotation on top of the valve stem like a machined convex surface, etc.

As further shown in FIG. 15, a pair of springs 1518 (only one shown) are provided on opposite sides of the valve bridge 1500, with respective ends of each spring 1518 contacting, preferably fastened to, to opposite bridge portions 1502, 1504. For example, on the first bridge portion 1502, a pair of laterally extending flanges 1520 are provided to contact a first leg of each spring 1518, whereas on the second bridge portion 1504, a common leg 1522 (in this embodiment) of the springs 1518 contacts an upper surface of the second bridge portion 1504. As shown, each of the springs 1518 is disposed along a lateral surface of the bridge portions 1502, 1504 such that uppermost surfaces of the bridges portions 1502, 1504 (particularly in the region of the central location 1516) are readily accessible for contact with an upstream valvetrain component, and so that rotation of the bridge portions 1502, 1504 downward will give rise to further contact with either of the springs 1518.

In an embodiment, the springs 1518 are configured to have respective preloads biasing the bridge portions 1502, 1504 into upright positions, i.e., as illustrated in FIG. 15. Furthermore, the preloads of the springs 1518, when combined, are of sufficient magnitude to maintain the bridge portions 1502, 1504 in their upright positions despite application of positive power generation valve actuation motions to the valve bridge 1500 at the central location 1517. However, when faced with an overload condition, the force applied to the valve bridge 1500 will eventually surpass a threshold where the designed, combined preloads of the springs 1518 will be overcome, thereby causing the bridge portions 1502, 1504 to rotate downward about their respective spherical mounts 1506, 1508. In this manner, the valvetrain components are protected against damage that may otherwise have occurred if a conventional valve bridge had been employed. Furthermore, once the overload condition has been alleviated and/or upon conclusion of a valve actuation motions being applied to the valve bridge 1500, the bias applied by the springs 1518 will cause the bridge portions 1502, 1504 to rotate upward once again (up to travel limits incorporated, for example, into the spherical mounts 1506, 1508) and resume their upright positions.

Figure 16A:
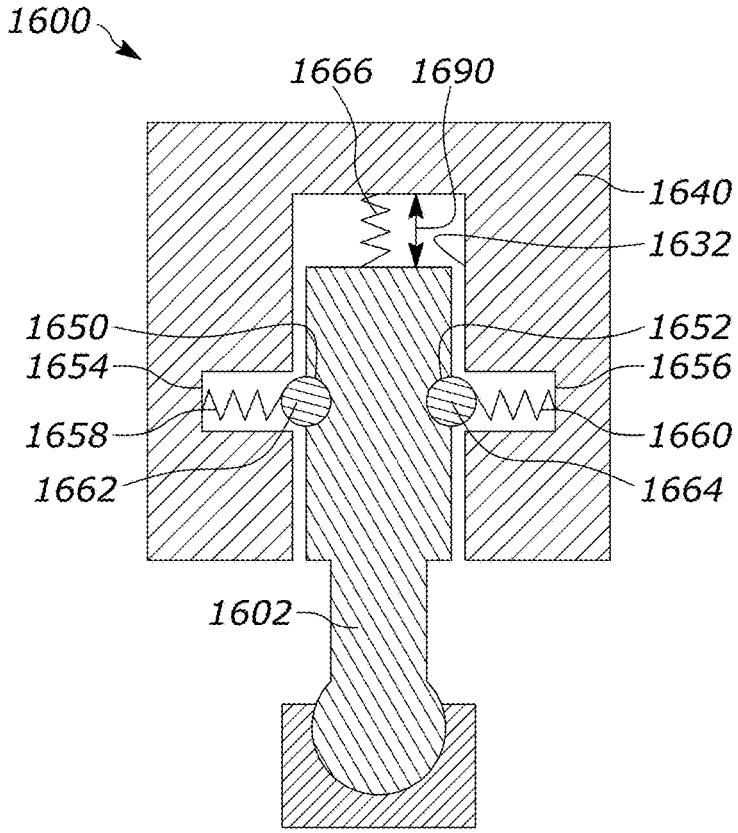
Figure 16B:
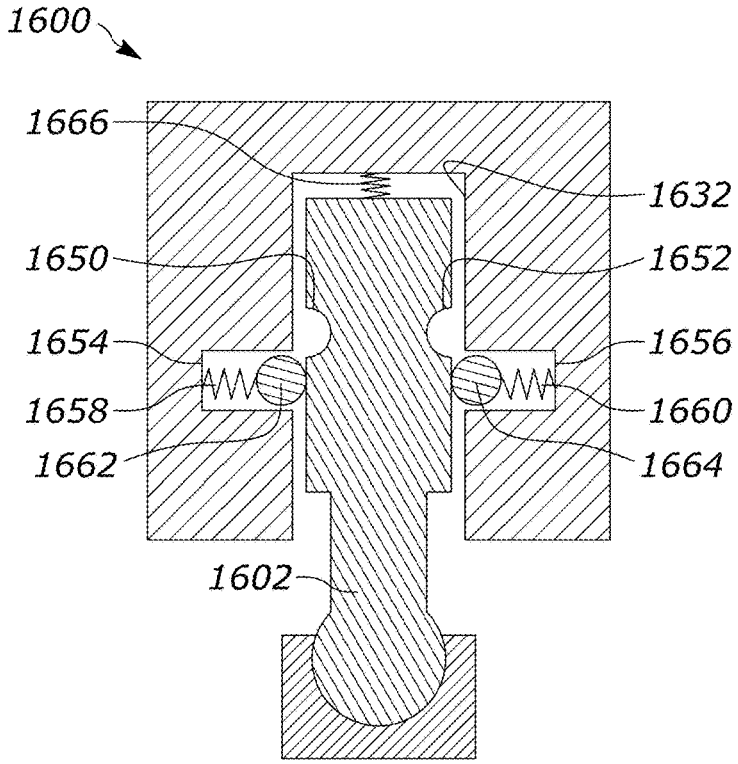

Referring now to FIGS. 16A and 16B, cross-sectional views of a second resetting embodiment are illustrated in the form of an e-foot assembly 1600. In this embodiment, the e-foot assembly 1600 comprises a rod 1602 slidably disposed in a bore 1632 formed in a host valve train component 1640 (e.g., a rocker arm). The rod 1602 comprises detents 1650, 1652 formed on an outer surface of the rod 1602 and diametrically opposed to each other. In an embodiment, the detents 1650, 1652 could be replaced with an annular channel formed about the circumference of the rod 1602. The host valve train component 1640 has diametrically opposed channels 1654, 1656 radially extending from an inner surface of the bore 1632. Bias spring 1658, 1660 are disposed in respective ones of the channels 1654, 1656 and biases a corresponding ball 1662, 1664 into a respective one of the detents 1650, 1652 when the detents 1650, 1652 are aligned with the channels 1654, 1656. Furthermore, a rod bias spring 1666 is deployed between the rod 1602 and a closed end of the bore 1632. The rod bias spring 1666 provides a force tending to bias the rod 1602 out of the bore 1632.

The bias springs 1658, 1660 are designed to have preload values that cause the balls 1662, 1664 to be biased into contact with the respective detents 1650, 1652 with sufficient force that the rod 1602 is maintained in its aligned position (i.e., in which the detents 1650, 1652 align with the channels 1654, 1656 as shown in FIG. 16A) despite application of valve actuation motions to the e-foot assembly 1600 for positive power generation operation. In this manner, such valve actuation motions are conveyed by the e-foot assembly 1600 to downstream valvetrain components and on to the engine valves.

However, the preload values of the bias springs 1658, 1660 are also designed such that, when an overload condition is encountered by the e-foot assembly 1600, the retention force applied by the balls 1662, 1664 to the rod 1602 is overcome thereby causing the balls 1662, 1664 to disengage from the detents 1650, 1652 and retract into their corresponding channels 1654, 1656 as shown in FIG. 16B. As a result, the rod 1602 is then free to translate within the bore 1632 under the load applied by a valve actuation motion until such time that the rod 1602 bottoms out in the bore 1632 or is otherwise travel limited to a lost motion distance 1690, as shown. Such translation of the rod 1602 also causes the rod bias spring 1666 to compress as further shown in FIG. 16B. When the load applied to the e-foot assembly 1600 is removed, the bias applied to the rod 1602 by the rod bias spring 1666 urges the rod 1602 out of the bore 1632 until such time that the detents 1650, 1652 are once again aligned with the channels 1658, 1560, thereby once again permitting the balls 1662, 1664 to reengage with the detents 1650, 1652 as described above.

Figure 17A:
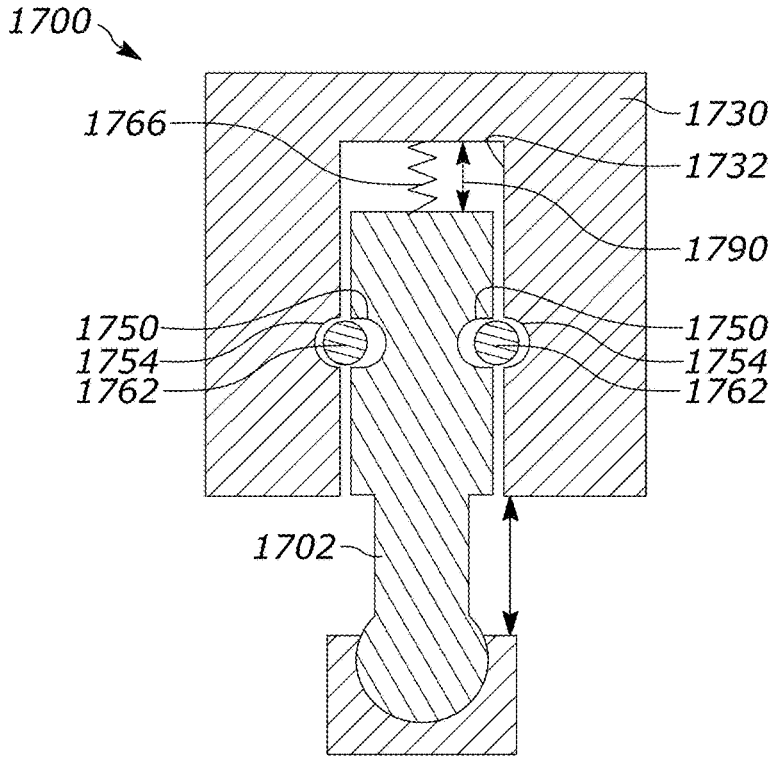
Figure 17B:
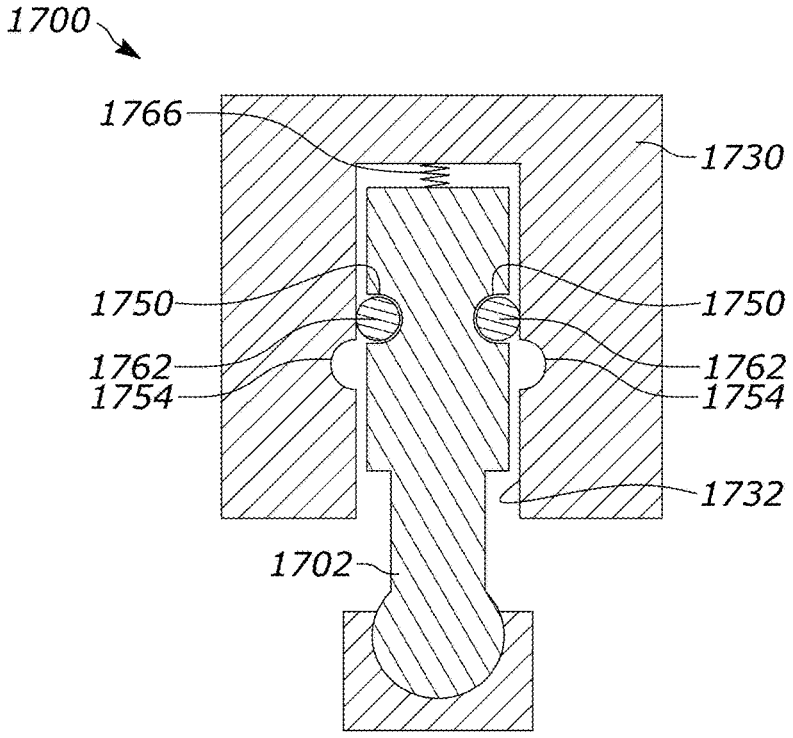

Referring now to FIGS. 17A and 17B, cross-sectional views of a third resetting embodiment are illustrated in the form of another e-foot assembly 1700. In this embodiment, the e-foot assembly 1700 comprises a rod 1702 slidably disposed in a bore 1732 formed in a host valvetrain component 1730 (e.g., a rocker arm). The rod 1702 comprises an annular channel 1750 formed about a circumference of and in an outer surface of the rod 1702. Further to this embodiment, the host valve train component 1740 has an annular channel 1754 formed about a circumference of and in an inner surface of the bore 1732. Furthermore, a rod bias spring 1766 is deployed between the rod 1702 and a closed end of the bore 1732. The rod bias spring 1766 provides a force tending to bias the rod 1702 out of the bore 1732.

As with the embodiment of FIG. 8 and as depicted in FIG. 17A, the c-ring 1762 is configured to engage with both of the annular channels 1750, 1754. In particular, when the annular channels 1750, 1754 are aligned (vertically, as depicted in FIG. 17A), the c-ring 1762 is permitted to expand such that it is capable of contacting both the annular channels 1750, 1754 at the same time. In this manner, as depicted in FIG. 17A, the c-ring 1762 effectively couples the rod 1702 to the host valve train component 1740.

However, when, as depicted in FIG. 17B, a sufficient load is placed on the e-foot assembly 1700, interaction of the c-ring 1762 with the annular channel 1754 provided in the host valve train component 1740 will cause the c-ring 1762 to flex inwardly and more fully into the annular channel 1750 provided in the rod 1702. As the c-ring 1762 retracts from the annular channel 1754 in the host valvetrain component 1730, the ability of the c-ring 1762 to maintain alignment of the annular channels 1750, 1754 will eventually be exceeded, thereby permitting the rod 1702 to slide within the bore 1732, as shown in FIG. 17B, under the load applied by a valve actuation motion until such time that the rod 1702 bottoms out in the bore 1732 or is otherwise travel limited to the lost motion distance 1790. Such translation of the rod 1702 also causes the rod bias spring 1766 to compress as further shown in FIG. 17B. When the load applied to the e-foot assembly 1700 is removed, the bias applied to the rod 1702 by the rod bias spring 1766 urges the rod 1702 out of the bore 1732 until such time that the annular channels 1750, 1754 are once again aligned with each other, thereby once again permitting the c-ring 1762 to reengage with both of the annular channels 1750, 1754 as described above. As noted in connection with the embodiment of FIG. 8, it is understood that the c-ring 1762 could also flex outwardly during overload conditions, i.e., into the annular channel 1754 formed in the host valve train component 1740.

Figure 18A:
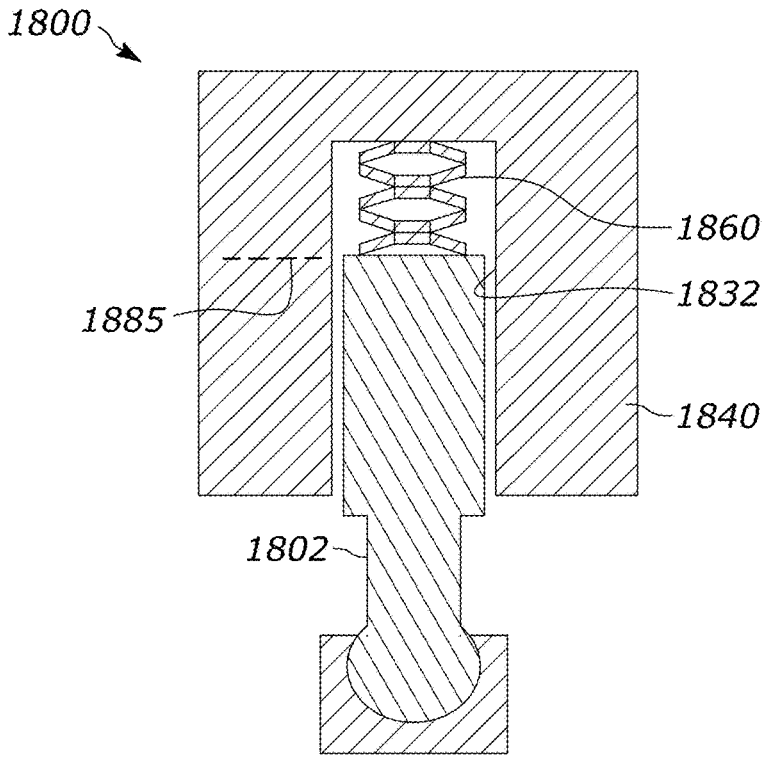
Figure 18B:
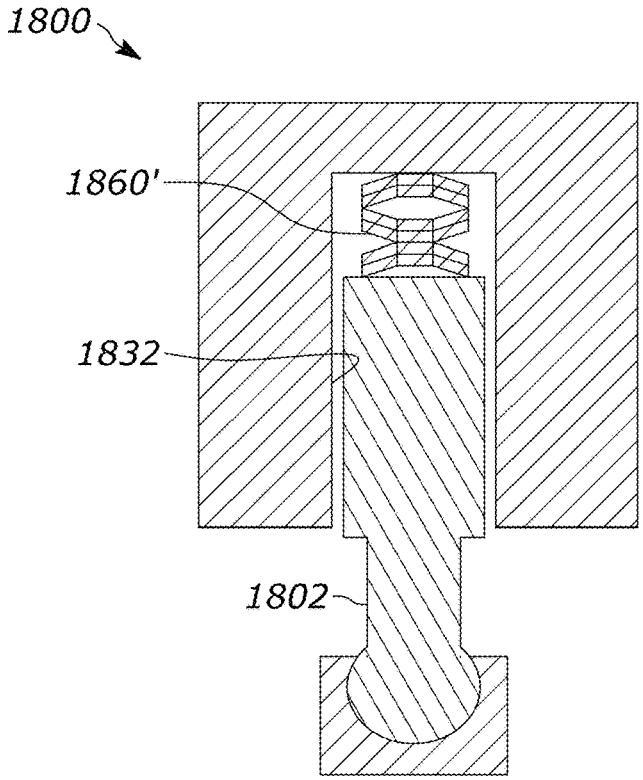
Figure 18C:
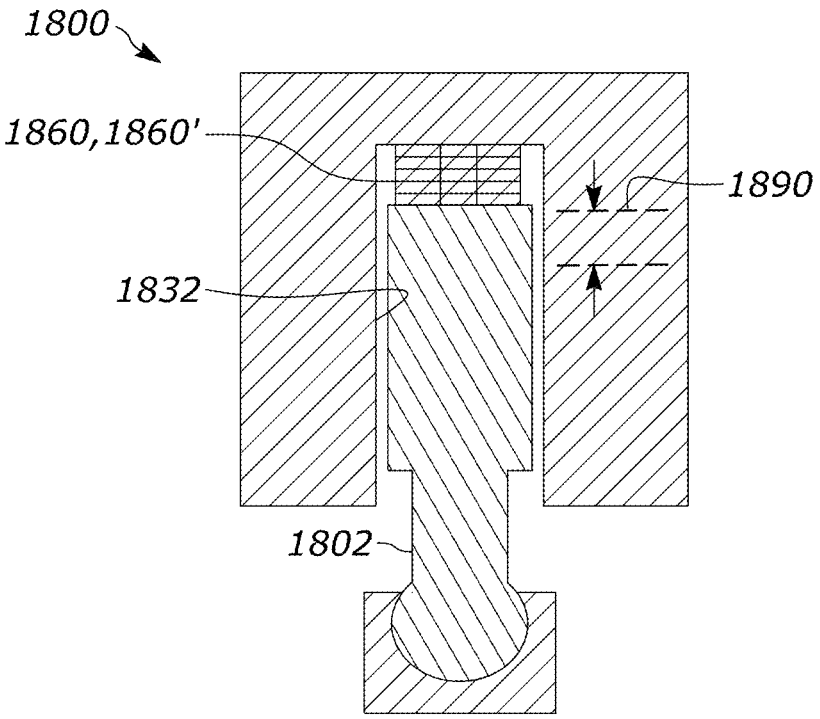

Referring now to FIGS. 18A through 18C, cross-sectional views of a fourth resetting embodiment are illustrated in the form of another e-foot assembly 1800. Once again, the e-foot assembly 1800 comprises a rod 1802 slidably disposed in a bore 1832 formed in a host valve train component 1840. In this case, a plurality of Belleville washers 1860 are provided between the rod 1802 and a closed end of the bore 1832. In the embodiment shown in FIG. 18A, the Belleville washers 1860 are arranged in a "series" stacked formation in which each Belleville washer 1860 is opposed to adjacent washers, i.e., convex sides of each washer abut each other, and concave sides of each washer also abut each other. As will be appreciated by those skilled in the art, other configurations of Belleville washers may be equally employed. For example, FIG. 18B illustrates a stack of Belleville washers 1860' in which pairs of washers are arranged in "parallel" formations, i.e., nested within each other, with each washer pair being arranged in series formation relative to adjacent washer pairs.

Regardless of the particular manner in which they are stacked, the plurality of Belleville washers 1860, 1860' operate to maintain the rod 1802 in an extended position 1885 out of the bore 1832. The preloads inherent in the Belleville washers 1860, 1860' can be selected so as to maintain the rod 1802 in its extended position (i.e., as shown in FIGS. 18A and 18B) despite application of normal, positive power generation valve actuations. However, when the collective preload provided by the Belleville washers 1860, 1860' is exceed, as may occur during an overload condition, one or more of the Belleville washers 1860, 1860' will deflect and collapse as shown in FIG. 18C, thereby permitting the rod 1802 to translate within the bore 1832 no more than a lost motion distance 1890. In this case, travel of the rod 1802 will be limited when the Belleville washers 1860, 1860' are completely flattened so as to provide a solid contact surface against the rod 1802. When the load applied to the e-foot assembly 1800 is removed, Belleville washers 1860, 1860' will once again revert to their normal preload state and the bias applied by the Belleville washers 1860, 1860' to the rod 1802 will urge the rod 1802 out of the bore 1832 until such time that the Belleville washers 1860, 1860' are all fully recovered or the rod 1802 is travel limited (by other travel limiting means not shown).

Figure 19A:
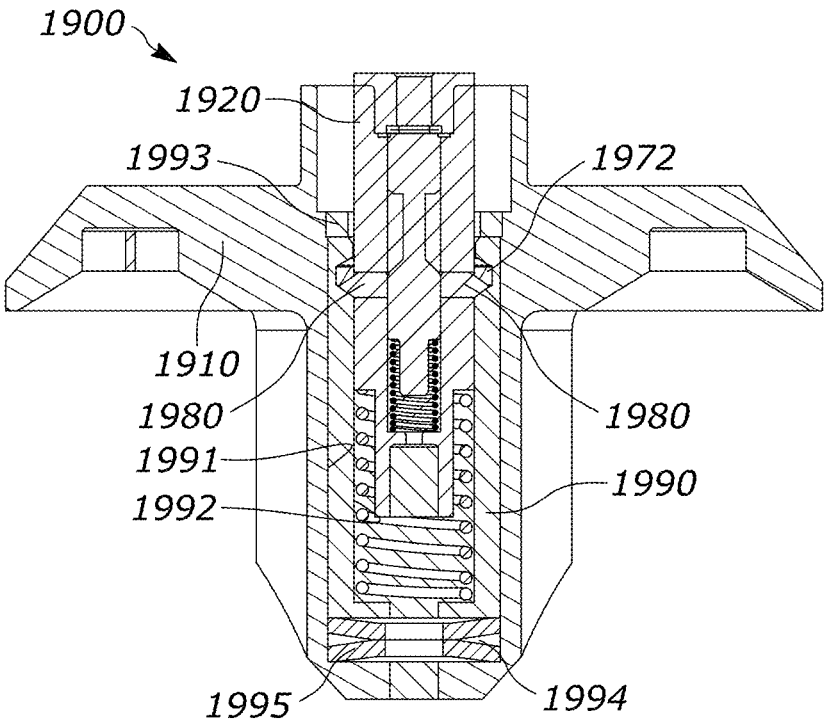
Figure 19B:
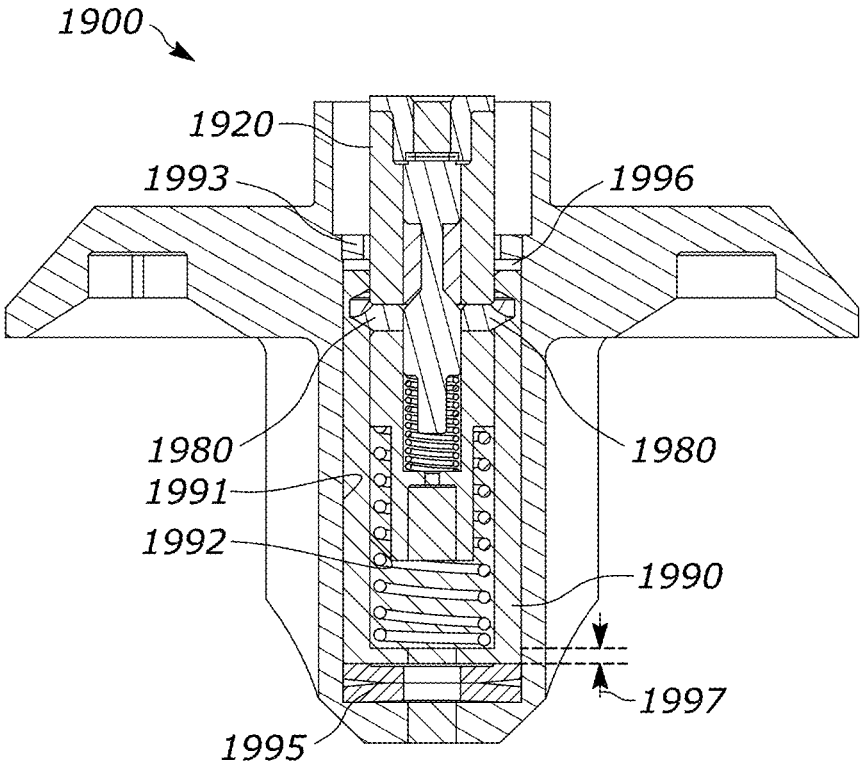

An embodiment of a valve bridge 1900, similar to the valve bridge depicted in FIG. 9, and incorporating the technique of the fourth resetting embodiment of FIGS. 18A-C is further illustrated in FIGS. 19A and 19B. In particular, FIGS. 19A and 19B illustrate respective side, cross-sectional views of the valve bridge 1900, which is once again similar to the valve bridge depicted in the '180 patent. Thus, the valve bridge 1900 comprises a locking mechanism comprising two locking wedges 1980 deployed within a plunger 1920 and configured to engage with an outer recess 1972.

However, in this implementation, the outer recess 1972, rather than being formed in the valve bridge body 1910, is instead formed in an inner surface of a sleeve 1990, which sleeve 1990 is slidably disposed in a bore 1991 formed in the valve bridge body 1910. In turn, the plunger 1920 is slidable disposed within a sleeve bore 1992 such that the plunger 1920 may be locked/unlocked from the sleeve 1990 through operation of the locking wedges 1980. The sleeve 1990 is retained in the valve body bore 1991 by a suitable fastener 1993 having a central opening permitting slidable passage of the plunger 1920 therethrough, e.g., a collet nut with external threads. As further shown, a longitudinal length of the sleeve 1990 is configured to be smaller than a longitudinal length of the bore 1991 in which it is disposed, such that a space 1994 is provided. In this embodiment, one or more Belleville washers 1995 (in their resting or undeflected state) are disposed in the space 1994 thereby preferably maintaining the sleeve 1990 abutted against the fastener 1993.

As before, the Belleville washers 1995 shown in FIG. 19 are selected such that their collective preload is sufficiently high to maintain the sleeve 1990 in abutment with the fastener 1993 despite application of normal, positive power generation valve actuations. However, when the collective preload provided by the Belleville washers 1995 is exceeded, as may occur during an overload condition, one or more of the Belleville washers 1995 will deflect and collapse as shown in FIG. 19B, thereby permitting the sleeve 1990 to translate downward within the bore 1991, thereby developing a gap 1996 between the sleeve 1990 and fastener 1993. The valve actuation motion lost through development of the gap 1996 (i.e., the lost motion distance 1997) will give rise to the desired centered lift until such time that the overload condition is removed, thereby permitting the Belleville washers 1995 to resume their normally loaded state.

Figure 20:
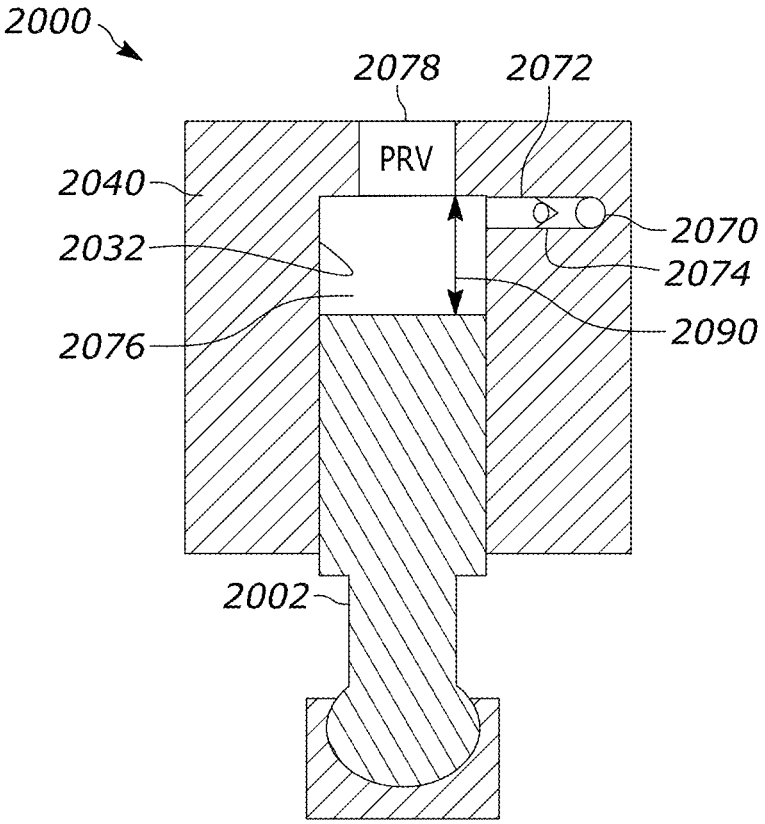

Referring now to FIG. 20, a cross-sectional view of a sixth resetting embodiment is illustrated in the form of an e-foot assembly 2000. In this embodiment, the overload feature comprises a rod 2002 slidably disposed within a bore 2032 formed in a host valvetrain component 2030. A hydraulic fluid supply passage 2070 is also provided in the host valvetrain component 2040 and configured to supply hydraulic fluid (e.g., engine oil) to a fluid inlet 2072. The fluid inlet 2072 is, in turn, in fluid connection with that portion of the bore 2032 between the rod 2002 and the closed end of the bore 2032, thereby providing a closed chamber 2076. A check valve 2074 is provided in the fluid inlet 2072 to prevent flow of hydraulic fluid from the closed chamber 2076 back into the hydraulic fluid supply passage 2070. Additionally, a configurable pressure relief valve 2078 is provided in fluid communication with the closed chamber 2076, as shown. As known in the art, the fit between the rod 2002 and the bore 2032 may be configured such that hydraulic fluid supplied to the closed chamber 2076 is permitted to leak out of the closed chamber 2076 only very slowly.

During positive power generation operation, hydraulic fluid is permitted to flow into the chamber 2076 such that the rod 2002 is biased out of the bore 2032 to a desired extent (with the possible addition of travel limiting, not shown, to prevent overextension of the rod 2002 out of the bore 2032). Given the incompressibility of the hydraulic fluid in the chamber 2076, the rod 2002 is maintained in its extended state despite the application of valve actuation motions to the e-foot assembly 2000. Additionally, the pressure relief valve 2078 is configured such that pressures induced in the chamber 2076 will be well below a threshold required to cause the pressure relief valve 2078 to open. On the other hand, the occurrence of an overload condition will cause pressures in the chamber 2076 to exceed the valve opening threshold of the pressure relief valve 2078, thereby evacuating the chamber 2076 and permitting the rod 2002 to slide into the bore 2032 (preferably travel limited to a lost motion distance 2072 so as to occlude the fluid inlet 2072). In this manner, conveyance of any valve actuation motions applied to the e-foot assembly 2000 is delayed. When the load applied to the e-foot assembly 2000 is removed, hydraulic fluid will be permitted to once again flow into the chamber 2076 via the inlet 2072, thereby refilling the chamber 2076 and once again resetting the rod 2002 to its extended position.

Figure 21:
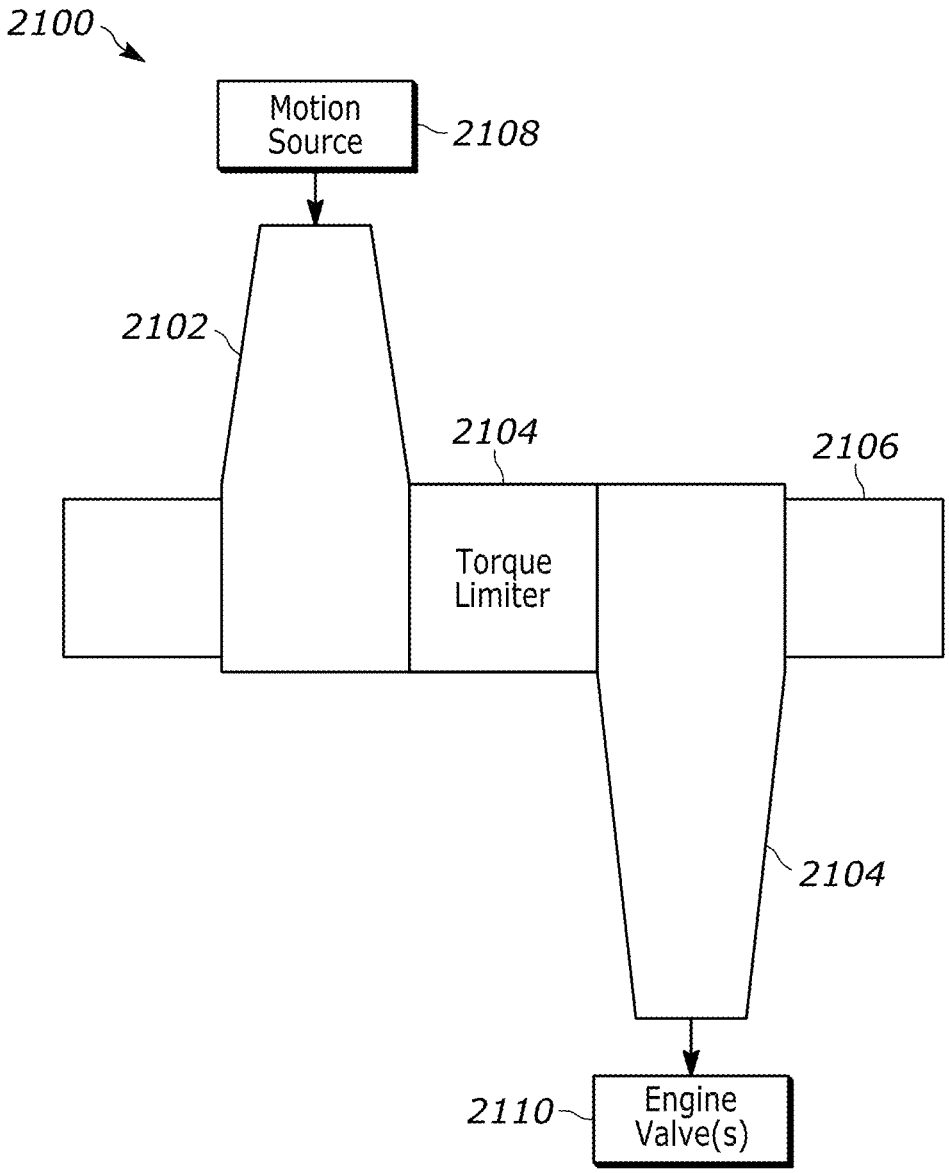
FIG. 21 illustrates an embodiment of a valve train component comprising a resetting or reversible overload feature in accordance with the instant disclosure.

Finally, referring now to FIG. 21, a top-down view of a seventh resetting embodiment is illustrated in the form of a rocker assembly 2100. In this embodiment, the rocker assembly 2100 comprises first and second half rockers 2102, 2104 rotatably mounted on a rocker shaft 2106. In accordance with known techniques, the first half rocker 2102 is operatively connected to a valve actuation motion source 2108 (e.g., to a cam via a roller follower) whereas the second half rocker 2104 is operatively connected to one or more engine valves 2110. As further shown, the first half rocker 2102 is operatively connected to an input of a torque limiter 2104 and the second half rocker 2104 is operatively connected to an output of the torque limiter 2104. In an embodiment, the torque limiter 2104 may also be mounted on the rocker shaft 2106 such that the respective input and output of the torque limiter 2104 may rotate about the rocker shaft 2106.

As known in the art, the torque limiter 2104 operates to limit the amount of torque that can be passed from the input to the output, thereby preventing excessive amounts of torque from being transmitted. Any of a variety of resetting torque limiters (e.g., a so-called slip clutch, ball detent limiter, pawl spring limiter, etc.) may be used to implement the torque limiter. In practice, the torque limiter 2104 would be configured to disengage its input from its output in response only to overload conditions, whereas normal operating conditions would permit valve actuation motions to be passed from the first half rocker 2102 to the second half rocker 2104 via the torque limiter 2104.

While the various embodiments in accordance with the instant disclosure have been described in conjunction with specific implementations thereof, it is evident that many alternatives, modifications and variations will be apparent to those skilled in the art. For example, although various mentions are made herein concerning the occurrence of an overload condition during positive power generation operation, it is appreciated that such overload conditions are not limited to occurring only during positive power generation operation. Rather, it is appreciated that such overload conditions can occur during almost any type of engine operation, e.g., auxiliary mode operation. Furthermore, while various configurations of components have been described herein to implement of travel limiting, e.g., rods/e-feet contacting other surfaces of an overload feature, it is understood that the instant disclosure is not limited in that regard.

Accordingly, the preferred embodiments of the invention as set forth herein are intended to be illustrative and not limiting so long as the variations thereof come within the scope of the appended claims and their equivalents.

What is claimed is:

1. A valve train component for conveying valve actuation motions within an internal combustion engine, the valve train component comprising:

a body member having a bore formed therein;

a sliding member disposed in the bore; and an overload feature operatively connected to the body member and the sliding member, wherein the overload feature is configured to not yield when a load placed on the overload feature is less than a load threshold, thereby preventing movement of the sliding member into the bore, and wherein the overload feature is configured to yield when a load placed on the overload feature meets or exceeds the load threshold, thereby permitting movement of the sliding member into the bore such that at least a portion of the valve actuation motions is not conveyed by the valve train component.

2. The valve train component of claim 1, wherein the body member is an integral portion of the valve train component.

3. The valve train component of claim 1, wherein the body member is a sleeve secured to the valve train component.

4. The valve train component of claim 1, wherein the sliding member comprises a sleeve configured to slide within the bore.

5. The valve train component of claim 1, wherein the movement of the sliding member into the bore is travel limited.

6. The valve train component of claim 5, wherein travel limited movement of the sliding member into the bore is configured to convey a high lift portion of the valve actuation motions.

7. The valve train component of claim 1, wherein the overload feature yields irreversibly.

8. The valve train component of claim 7, wherein the overload feature comprises a shearing element disposed between the body member and the sliding member.

9. The valve train component of claim 7, wherein the overload feature comprises a force fit between the sliding member and body member.

10. The valve train component of claim 7, wherein the overload feature comprises at least one weld between the body member and the sliding member.

11. The valve train component of claim 7, wherein the overload feature comprises a frangible feature formed in the body member.

12. The valve train component of claim 1, wherein the overload feature yields reversibly.

13. The valve train component of claim 12, wherein the overload feature comprises at least one resilient element.

14. The valve train component of claim 13, wherein the at least one resilient element comprises a c-ring configured to engage notches formed in the body member and the sliding member.

15. The valve train component of claim 13, wherein the at least one resilient element is a constituent of at least one detent formed between the body member and the sliding member.

16. The valve train component of claim 13, wherein the at least one resilient member is one or more Belleville washers residing in the bore between the body member and the sliding member.

17. The valve train component of claim 12, wherein the overload feature comprises:

a one-way fluid supply in fluid communication with a portion of the bore between the body member and the sliding member; and a pressure relief valve in fluid communication with the portion of the bore between the body member and the sliding member.

18. The valve train component of claim 1, wherein the valve train component is any of a tappet, a push tube, a rocker arm or a valve bridge.

19. An internal combustion engine comprising the valve train component of claim 1.

* * * * *